US011427391B2

(12) United States Patent
Comerford

(10) Patent No.: US 11,427,391 B2
(45) Date of Patent: Aug. 30, 2022

(54) SHIPPING CONTAINER SYSTEMS

(71) Applicant: Brent Michael Comerford, Aliso Viejo, CA (US)

(72) Inventor: Brent Michael Comerford, Aliso Viejo, CA (US)

( * ) Notice: Subject to any disclaimer, the term of this patent is extended or adjusted under 35 U.S.C. 154(b) by 0 days.

(21) Appl. No.: 17/342,446

(22) Filed: Jun. 8, 2021

(65) Prior Publication Data

US 2022/0119179 A1 Apr. 21, 2022

Related U.S. Application Data

(63) Continuation-in-part of application No. 17/072,646, filed on Oct. 16, 2020.

(51) Int. Cl.

| | |
|---|---|
| ***B65D 77/04*** | (2006.01) |
| ***B65D 81/02*** | (2006.01) |
| ***B65D 81/107*** | (2006.01) |

(52) U.S. Cl.

CPC ..... *B65D 77/0413* (2013.01); *B65D 81/022* (2013.01); *B65D 81/107* (2013.01)

(58) Field of Classification Search

CPC . B65D 77/0413; B65D 81/022; B65D 81/107

USPC ..... 206/591, 583, 521; 229/120.11, 185.1

See application file for complete search history.

(56) References Cited

U.S. PATENT DOCUMENTS

| | | | | |
|---|---|---|---|---|
| 4,257,550 A * | 3/1981 | Frohlicher | B65D 5/22 | 206/807 |
| 5,002,188 A * | 3/1991 | Dickie | B65D 5/5021 | 206/589 |
| 5,223,121 A * | 6/1993 | Dickie | B65D 5/5021 | 206/591 |
| 5,495,983 A * | 3/1996 | Lelek | B65D 5/48018 | 206/315.2 |
| 6,523,694 B2 * | 2/2003 | Lux, Jr. | B65D 5/0254 | 206/769 |
| 7,661,578 B2 * | 2/2010 | Li | B65D 5/103 | 229/120.13 |
| 10,683,154 B2 * | 6/2020 | Hammerschmidt | B65B 43/10 | |

(Continued)

*Primary Examiner* — J. Gregory Pickett
*Assistant Examiner* — Jenine Pagan
(74) *Attorney, Agent, or Firm* — Camuti Law Group, APC; Nathan Camuti

(57) ABSTRACT

There is disclosed a packaging system including an outer container having a bottom and four upstanding sidewalls defining an outer container volume, the outer container further comprising an outer container top, and an inner compartment having an inner compartment bottom, four upstanding sidewalls including an inner compartment front, an inner compartment back, and two opposing inner compartment ends, the four upstanding walls bounding a perimeter of the inner compartment bottom, and an inner compartment top, wherein the inner compartment is formed by an inner compartment panel folded to form the inner compartment bottom, the four upstanding inner compartment sidewalls and the inner compartment top, wherein the packaging system includes a plurality of suspension elements maintaining an air gap between the outer container and the inner compartment, and wherein the outer container and the inner compartment are formed from a packaging system material.

12 Claims, 16 Drawing Sheets

(56) References Cited

U.S. PATENT DOCUMENTS

2011/0240515 A1* 10/2011 Ridgeway ..... B65D 5/5028
206/583
2015/0314936 A1* 11/2015 Stack, Jr. ..... B65D 5/5035
206/488

* cited by examiner

SHIPPING CONTAINER SYSTEMS

BACKGROUND

Shipping products to consumers has become a vital part of our everyday lives. Shipping containers are typically designed to maximize efficiency in packing shipping vehicles. Frequently, a shipping container contains items that fill only a small portion of the volume of the container, requiring the space to be filled with other material, such as air-filled plastic pouches or shredded paper. Alternative solutions include affixing products to a piece of cardboard using plastic film of sorts and adding some pieces to cause the plastic wrapped board and product to remain positioned in the cavity of the box. Existing solutions are expensive and use excess materials, including excessive waste materials. More economical and ecologically friendly systems are needed.

SUMMARY

The present disclosure is directed to shipping container systems, substantially as shown in and/or described in connection with at least one of the figures, as set forth more completely in the claims. In one embodiment of the present disclosure, the shipping container system includes an outer container having a base, a plurality of upstanding walls extending from the base, the base and upstanding walls defining a cavity. The upstanding walls include a corresponding plurality of closure flaps. The corresponding plurality of flaps may overlay the base and substantially cover the opening of the cavity when the outer container is in a closed configuration. The plurality of closure flaps may be hingedly attached to the ends of the upstanding walls opposite the base. At least one of the corresponding plurality of closure flaps may include a securing element extending from a side of the closure flap such that the securing element may be oriented to fit downwardly into the cavity of the outer container when the closure flaps are in a closed configuration. At least one other of the corresponding plurality of flaps may be paired with the at least one of the corresponding plurality of closure flaps having the securing element, the one other having a corresponding aperture for receiving the securing element when the outer container is in a closed configuration.

The shipping container system may further include a suspension insert. The shipping suspension insert may include a product retention compartment extending from a first end to a second end opposite the first end, the product retention compartment including a selectively closable flap on either end extending from a lower section of the product retention compartment and substantially covering and closing the end of the product retention compartment. The suspension insert further comprises a suspension unit connected to and extending from an upper section of the product retention compartment. The suspension unit includes width securing elements extending outwardly beyond the width of the product retention compartment sufficient to substantially fill the width of the outer container to hold the product retention compartment secure in the width of the outer container and leaving a gap between the upstanding walls of the outer container and the product retention compartment.

In other embodiments, the suspension insert may include a plurality selectively closable flaps on either end of the product retention compartment. The selectively closable flap may be hingedly attached to the lower section of the product retention compartment. In some embodiments, the selectively closable flap may include an additional structural support element cut out of the lower section of the product retention compartment and configured so that the additional structural support element rotates downwardly to create an additional lower support to the suspension insert when the selectively closable flap is hingedly rotated upward to a closed configuration, substantially covering the open end of the product retention compartment. The additional structural support element may extend downwardly to the base of the outer container. Thus, when the suspension insert is in the closed configuration and installed in the outer container, the suspension insert may secure the product retention compartment in the length, width, and height of the outer container, and the additional structural support element may add additional structural support to the system, strengthening the system in a downward direction securing the product retention compartment in the outer container.

The shipping container system of the present disclosure may be made from corrugated board, paper board, flexible plastics, foamed plastics, rigid plastics, corrugated plastics, or any combination thereof. In some embodiments, various components may be made of one of these materials and other components may be made from another of these materials.

One aspect of the present disclosure is that products are shipped using the shipping container system to keep the product suspended in the outer container. The inner product compartment of the system creates a suspended compartment with an air space above, below, and on all sides of the compartment. Including this space between the outer container and the inner product compartment may provide a safe and secure journey for the product being shipped.

In other embodiments, the system comprises an outer container comprising a base and a plurality of upstanding walls defining a cavity, a first closure flap extending from a top end of one of the upstanding walls opposite the base wherein the first closure flap overlays the base and substantially covers an opening formed by the top ends of the upstanding walls when the outer container is in a closed configuration, and wherein the first closure flap includes a retention element that extends from the closure flap downward into the cavity of the outer container when the outer container is in a closed configuration, and an suspension insert including a product retention compartment and a plurality of suspension units extending outwardly from the suspension unit creating and maintaining a suspension gap on all sides of the product retention compartment when the suspension insert is installed in the outer container; wherein the retention element exerts a retention force on a securing element of a corresponding one of the plurality of suspension units.

In other embodiments, the plurality of upstanding walls includes a pair of side walls and a pair of end walls.

In other embodiments, the system further comprises a second closure flap paired with the first closure flap, the second closure flap arranged to lie underneath the first closure flap when the outer container is in a closed configuration, and wherein the second closure flap includes a retention element aperture through which the retention element passes when the container is in the closed configuration.

In other embodiments, the suspension insert provides security for the product retention chamber in a length of the of the outer container, a width of the outer container, and a height of the outer container.

In other embodiments, the retention force holds the suspension insert secure vertically in a height of the outer container and laterally along a length of the outer container while maintaining the suspension gap between the product retention compartment and the outer container.

In other embodiments, the suspension unit further secures the suspension insert across a width of the outer container while maintaining the suspension gap between the product retention compartment and the outer container.

In other embodiments, the securing element of the suspension unit is a fold between a first section of the suspension unit and a second section of the suspension unit.

In other embodiments, the outer container is formed from a single blank.

In other embodiments, the suspension insert is formed from a single blank.

In other embodiments, the product retention compartment includes a selectively closable opening.

In other embodiments, the outer container is made from a recyclable material.

In other embodiments, the suspension insert is made from a recyclable material.

In some embodiments, the system comprises an outer container comprising a base, a pair of side walls and a pair of end walls, each side wall and each end wall extending from the base to a top end, the top ends of the side walls and the top ends of the end walls defining an opening, wherein each side wall further comprises a closure flap extending from and hingedly attached to the top end of the side wall and further comprising a retention element wherein the retention element extends from the closure flap at the top end of the container towards the base when the container is in a closed configuration, and wherein each end wall further comprises an inner closure flap extending from and hingedly connected to the top end of the end wall the inner closure flap further comprising a retention element aperture through which the retention element passes when the container is in the closed configuration.

In some embodiments, the system comprises a suspension insert formed from a single blank including an enclosed product retention compartment extending between a first end a second end, further comprising a first suspension unit connected to and extending from the first end of the product retention compartment, a second suspension unit connected to and extending from the second end of the product retention compartment, wherein the suspension units are wider than a width of the product retention compartment and taller than a height of the product retention compartment.

In some embodiments, the packaging system includes an outer container having an outer container bottom, four upstanding sidewalls defining an outer container volume, the four upstanding walls including an outer container front, an outer container back, and two opposing outer container ends, the four upstanding walls bounding a perimeter of the outer container bottom, the outer container further comprising an outer container top, wherein the outer container top overlays an aperture formed by the upper sides of each of the four upstanding walls opposite the outer container bottom when the outer container is in a closed configuration, wherein the two opposing outer container ends are formed by end wall panels extending from the outer container bottom panel, the end wall panels are folded upwards from the outer container bottom panel towards the top end of the upstanding walls of the outer container, folded over a corresponding pair of end wall tabs, folded downward towards the bottom of the outer container, an end wall panel securing tab extending from a terminal end of the end wall tab, the end wall panel securing tabs being secured in place by an end wall panel securing slot in the outer container bottom, and an inner compartment having an inner compartment bottom, four upstanding sidewalls including an inner compartment front, an inner compartment back, and two opposing inner compartment ends, the four upstanding walls bounding a perimeter of the inner compartment bottom, and an inner compartment top, wherein the inner compartment is formed by an inner compartment panel folded to form the inner compartment bottom, the four upstanding inner compartment sidewalls and the inner compartment top, wherein the packaging system includes a plurality of suspension elements maintaining an air gap between the outer container and the inner compartment, and wherein the outer container and the inner compartment are formed from a packaging system material.

In other embodiments, the outer container and the inner compartment are formed from a single panel of the packaging system material.

In other embodiments, the panel forming the inner compartment is an extension of one of the outer container walls, the panel forming the inner compartment extending into the outer container volume to form the inner compartment bottom, and wherein the panel forming the inner compartment bottom is further folded to form the inner compartment back, the inner compartment top, the inner compartment front, and the two opposing inner compartment ends.

In other embodiments, the panel forming the inner compartment is further configured to form the plurality of suspension elements configured to maintain an air gap between the inner compartment and the outer container.

In other embodiments, the portion of the packaging system material forming the inner compartment bottom extends outwardly beyond the two opposing inner compartment ends forming a pair of folded suspension elements extending from the inner compartment ends to an inner side of the outer container end walls.

In other embodiments, the outer container top includes a top portion, a front flap, and a pair of closure tabs, wherein the outer container end walls include a pair of closure flap retention slots disposed on a front end of each opposing outer container end, wherein the closure flap retention slots retain the closure tabs securing the outer container top when the outer container is in a closed configuration.

In other embodiments, the packaging system material is one of corrugated board, paper board, flexible plastics, foamed plastics, rigid plastics, corrugated plastics.

In other embodiments, the outer container is selectively closable.

In other embodiments, the inner compartment is selectively closable while the outer container is in an open configuration.

In other embodiments, the portion of the packaging system material forming the inner compartment bottom extends beyond each of the opposing inner compartment ends forming a pair of folding suspension elements extending from each end of the inner compartment, and wherein each of the folding suspension elements folds such that the portion of the folding suspension element proximate to the inner compartment extends upwards above the inner compartment top to an accordion fold further extending the terminal portion of the folding suspension element downwards past the inner compartment bottom, creating an upper and lower suspension element maintaining an upper air gap above the inner compartment and a lower air gap below the inner compartment when the inner compartment is installed in the outer container.

In other embodiments, each of the folding suspension elements extending from the ends of the inner compartment are wider than a width of the inner compartment such that a width of the folding suspension elements maintains a front air gap between the inner compartment front and the outer container, and a rear air gap between the inner compartment back and the outer container when the inner compartment is installed in the outer container.

DETAILED DESCRIPTION

Figure 1:
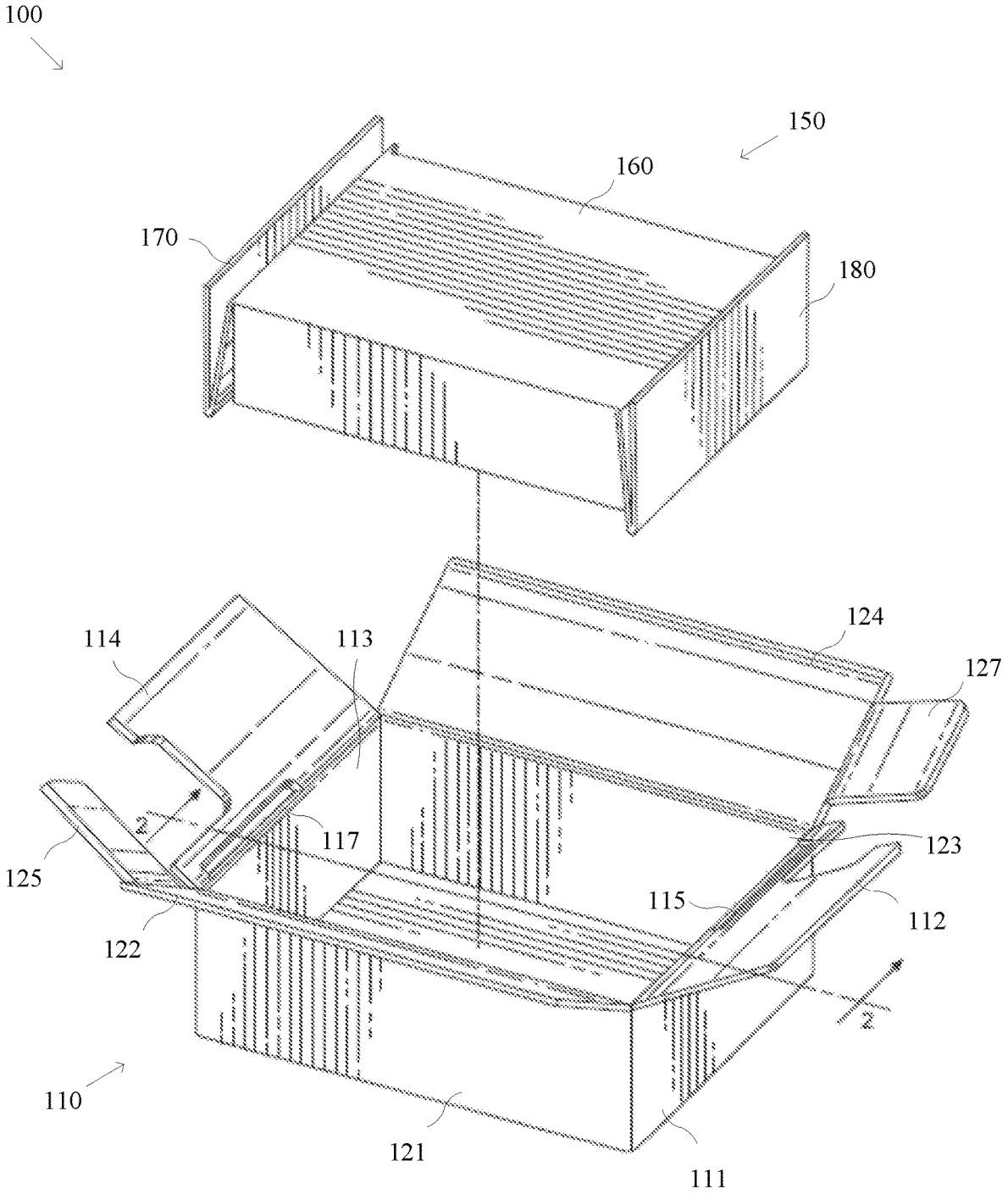
FIG. 1 shows an exploded view of the shipping container system, according to one embodiment of the present disclosure.

The following description contains specific information pertaining to embodiments in the present disclosure. The drawings in the present application and their accompanying detailed description are directed to merely exemplary embodiments. Unless noted otherwise, like or corresponding elements among the figures may be indicated by like or corresponding reference numerals. Moreover, the drawings and illustrations in the present application are generally not to scale and are not intended to correspond to actual relative dimensions.

FIG. 1 shows an exploded view of the shipping container system, according to one embodiment of the present disclosure. Shipping container system 100 includes outer carton 110 and suspension insert 150. Outer carton 110 may be a container used to package a product for shipping. As shown in FIG. 1, outer carton 110 is a rectangular shipping box having a length, width, and height. Outer carton 110 is formed by a rectangular base having a length and a width. In some embodiments, the length of outer carton 110 may be greater than the width of outer carton 110 or the same as the width of outer carton 110. Outer carton 110 includes upstanding walls extending from the sides of the base of outer carton 110. In some embodiments, the upstanding walls extend from the base of outer carton 110 to a top end, the top end of each of the upstanding wall being an end opposite the base of outer carton 110. In some embodiments, the upstanding walls and the base of outer carton 110 define a cavity. In some implementations, the top ends of outer carton 110 define an opening at a top end of outer carton 110 opposite the base of outer carton 110. In some embodiments, outer carton 110 includes closure flaps hingedly attached to and extending from the top ends of one or more of the upstanding walls.

As shown in FIG. 1, the upstanding walls of outer carton 110 include opposing pairs of walls. Specifically, the upstanding walls of outer carton 110 are opposing ends, end 111 and end 113, and opposing sides, side 121 and side 123. The height of the ends may be substantially the same as the height of the sides. As shown in FIG. 1, outer carton 110 includes closure flap 112 extending from the top end of end 111, closure flap 114 extending from the top end of end 113, closure flap 122 extending from the top end of side 121, and closure flap 124 extending from the top end of side 123. Outer carton 110 may be arranged in an open configuration, as shown in FIG. 1. Outer carton 110 may also be arranged in a closed configuration. In the closed configuration, closure flaps 112, 114, 122, and 124 may be rotated about their hinged attachment to ends 111 and 113 and sides 121 and 123 such that the closure flaps are oriented to substantially cover the opening defined by the top ends of the ends 111 and 113 and sides 121 and 123.

As shown in FIG. 1, outer carton 110 includes retention element 125 and retention element 127 hingedly attached to and extending from closure flaps 122 and 124, respectively. In some embodiments, the retention elements may be connected to and extend from a side of their respective closure flaps. In other embodiments, the retention elements may be connected to and extend from a terminal end of the closure flap, the terminal end of the closure flap being opposite the connection to the side of outer carton 110 from which the closure flap extends. When outer carton 110 is arranged in a closed configuration, retention element 125 and retention element 127 may be rotated to a position substantially perpendicular to the plane of closure flaps 122 and 124, respectively, and may extend downwardly from closure flaps 122 and 124 into the cavity of outer carton 110. In other embodiments, outer carton 110 may include a retention element may extend from the terminal end of one or more of closure flaps 122 and 124. In such an embodiment, one or more of closure flaps 122 and 124 may extend substantially across the opening formed by the top ends of the upstanding walls of outer carton 110 and substantially overlay the area of the base of outer carton 110.

Retention elements 125 and 127 may have a width less than half the width of outer carton 110, about the same as the width of outer carton 110, or greater than half the width of outer carton 110.

As shown in FIG. 1, the outer carton 110 includes minor flap 112 and minor flap 114 hingedly connected to and extending from end 111 and end 113, respectively. Minor flaps 112 and 114 may fold inwardly to cover a portion of the opening formed by the top ends of the upstanding walls of outer carton 110. Minor flaps 112 and 114 may be arranged underneath closure flaps 122 and 124 when outer carton 110 is arranged in a closed configuration. As shown in FIG. 1, minor flaps 112 and 114 include apertures 115 and 117, respectively. Apertures 115 and 117 are openings through minor flaps 112 and 114 to receive retention elements 125 and 127 when outer carton 110 is arranged in the closed configuration.

Suspension insert 150 includes product retention compartment 160 having a first end and a second end. Product retention compartment product retention compartment 160 may include an upper section and a lower section. The upper section, the lower section, and the ends of product retention compartment 160 define a volume. In some embodiments, product retention compartment 160 may include side walls extending between the upper section and the lower section. In other embodiments, the volume of product retention compartment 160 may be defined by the upper section and the lower section curving away from each other across the width of product retention compartment 160 in a pillow pack configuration. In other embodiments, product retention compartment 160 may include a plurality of sides defining a volume. The volume may be in any shape, such as a rectangular prism, a pillow pack, a pyramid, a tetrahedron, or other three-dimensional shape that may be used to contain a product for shipping purposes. In some embodiments, product retention compartment 160 may be a custom-made shape designed to fit a particular product.

In some embodiments, the first end of product retention compartment 160 may be selectively closable. The first end of product retention compartment 160 may be selectively closable by rotating a product retention compartment 160 end flap (not shown) to an orientation across and substantially covering the first end of product retention compartment 160. In some embodiments, the product retention compartment 160 end flap may be a rectangular flap covering width and height of the first end or product retention compartment 160. In other embodiments, the product retention compartment 160 end flap may be oblong or marquise shaped having a width and a curved upper edge and a curved lower edge. In some embodiments, the upper curved edge and the lower curved edge may be substantially symmetrical across an axis extending across the width of the opening of the first end of product retention compartment 160. The end flap of product retention compartment 160 may be hingedly attached to and extend from the lower section of product retention compartment 160 or the upper section of product retention compartment 160.

As shown in FIG. 1, suspension insert 150 includes a suspension unit extending from each end of product retention compartment 160. Suspension unit 170 extends from the first end of product retention compartment 160 and corresponds to the suspension unit extending from the second end of product retention compartment 160. As shown in FIG. 1, suspension unit 170 extends from the upper section of product retention compartment 160 and has a width wider than the width of product retention compartment 160 and a height taller than the height of product retention compartment 160 when arranged to be inserted into outer carton 110. Suspension unit 180 may be substantially the same as suspension unit 170 but extending from the second end of product retention compartment 160.

The components of shipping container system 100 may be made from corrugated board, paper board, flexible plastics, foamed plastics, corrugated plastics, or any combination thereof.

Figure 2:
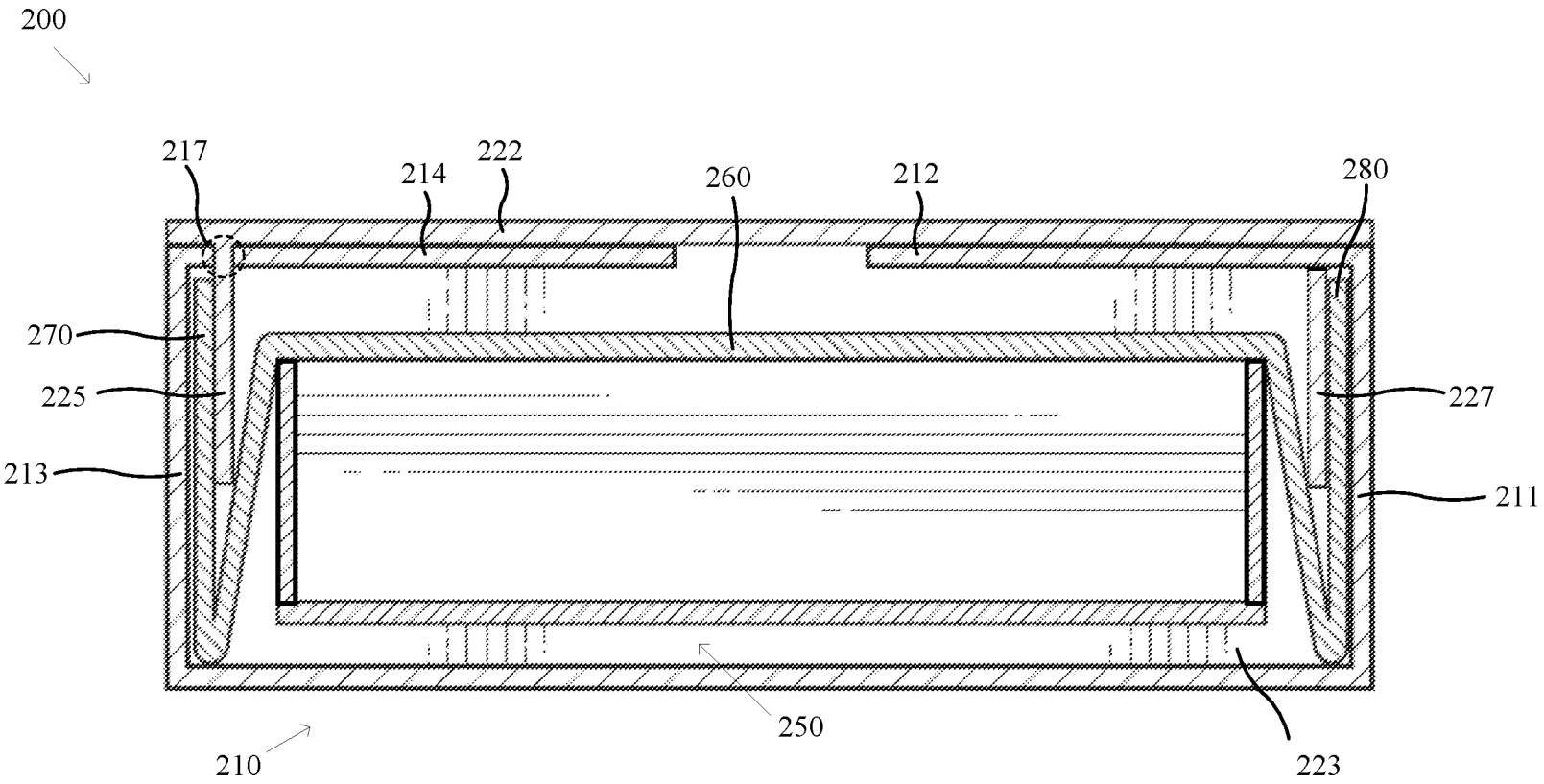
FIG. 2 shows a cross section of the shipping container system of FIG. 1 in a closed configuration, according to one embodiment of the present disclosure.

FIG. 2 shows a cross section of the shipping container system of FIG. 1 in a closed configuration, according to one embodiment of the present disclosure. As shown in FIG. 2, shipping container system 200 includes outer carton 210 and suspension insert 250. The cross-section view depicts the off-center cross section of the shipping container system shown in FIG. 1 arranged in the closed configuration. Outer carton 210 includes ends 211 and 213 from which minor flaps 212 and 214 extend, side 223 visible as the terminal end of shipping container system 200. Retention element 225 is shown extending from closure flap 222 through aperture 217 downwardly into the cavity of outer carton 210.

Retention element 227 is shown extending from closure flap 224 (not visible in the cross-section) downwardly into outer carton 210. Suspension unit 270 and suspension unit 280 are connected to and extend outwardly from the ends of suspension insert 250. Suspension insert 250, including suspension unit 270 and suspension unit 280, is shown to extend the inner length of the cavity in outer carton 210. Suspension unit 270 and suspension unit 280 fill the height of the inner cavity of outer carton 210. As shown in FIG. 2, product retention compartment 260 is suspended inside the cavity of outer carton 210. Shipping container system 200 suspends product retention compartment 260 inside outer carton 210 with open space above, below, and on either end of product retention compartment 260. Although not shown in the view of FIG. 2, product retention compartment 260 is additionally suspended in the width of outer carton 210 by the extension of suspension unit 270 and suspension unit 280 wider than the width of product retention compartment 260 and substantially filling the inner width of the cavity of outer carton 210.

Retention elements 225 and 227 are shown extending down into the cavity of outer carton 210. As shown in FIG. 2, retention elements 225 and 227 secure the terminal sections of suspension unit 270 and suspension unit 280. Folding suspension unit 270 is shown secured between end 213 and retention element 225. Folding suspension unit 280 is shown secured between end 211 and retention element 227. Retention elements 225 and 227 may additionally apply restrict motion of suspension insert 250 in the height of the inner cavity of outer carton 210. Items shipped using shipping container system 200 may be kept secure in shipping by the cushion space above, below, and beside product retention compartment 260 inside outer carton 210.

In some embodiments, retention elements 225 and 227 may extend further down into the height of the cavity of outer carton 210. Retention elements 225 and 227 may press further down and exert pressure on suspension unit 270 and in a downward direction from closure flaps 222 and 224 (not visible in cross section) towards the base of outer carton 210. In some embodiments, retention elements 225 and 227 may extend substantially into the cavity of outer carton 210, such as 50% of the internal height of outer carton 210, 60% of the internal height of outer carton 210, 70% of the internal height of outer carton 210, 80% of the internal height of outer carton 210, 90% of the internal height of outer carton 210, 95% of the internal height of outer carton 210, or 99% of the internal height of outer carton 210. The downward force exerted by retention elements 225 and 227 may provide security and cushioning to product retention compartment 260 and help secure a product transported therein.

Figure 3:
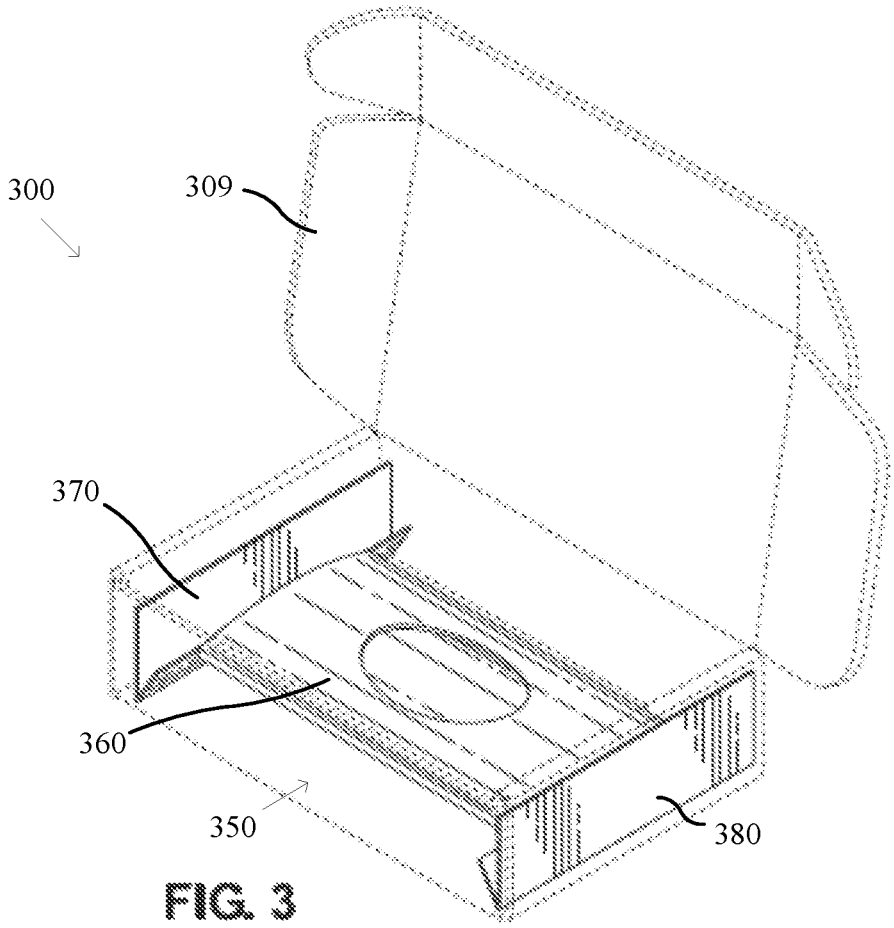
FIG. 3 shows a diagram of another shipping container system, according to one implementation of the present disclosure.

FIG. 3 shows a diagram of another shipping container system, according to one implementation of the present disclosure. Diagram 300 shows suspension insert 350 in a conventional shipping container to demonstrate that suspension insert 350 may secure products in conventional boxes as well and in combination with outer carton 110. As shown in FIG. 3, suspension insert 350 extends, with product retention compartment 360, suspension unit 370, and suspension unit 380 extending thorough the interior length of the cavity of box 309. As shown in FIG. 3, suspension unit 370 and suspension unit 380 extend through the interior height of the cavity of box 309. As shown in FIG. 3, suspension unit 370 and suspension unit 380 extend through the width of the interior cavity of box 309. As shown in FIG. 3, box 309 may have folding flaps that extend down into the cavity of box 309 and may engage with suspension unit 370 and suspension unit 380. In other embodiments, suspension unit 370 and suspension unit 380 secure product retention compartment 360 in the internal cavity of a conventional outer container, such as an easy fold mailing box, a conventional folding carton box, a conventional mailer box, a roll end tuck top style box, a conventional corrugated box, etc.

Figure 4:
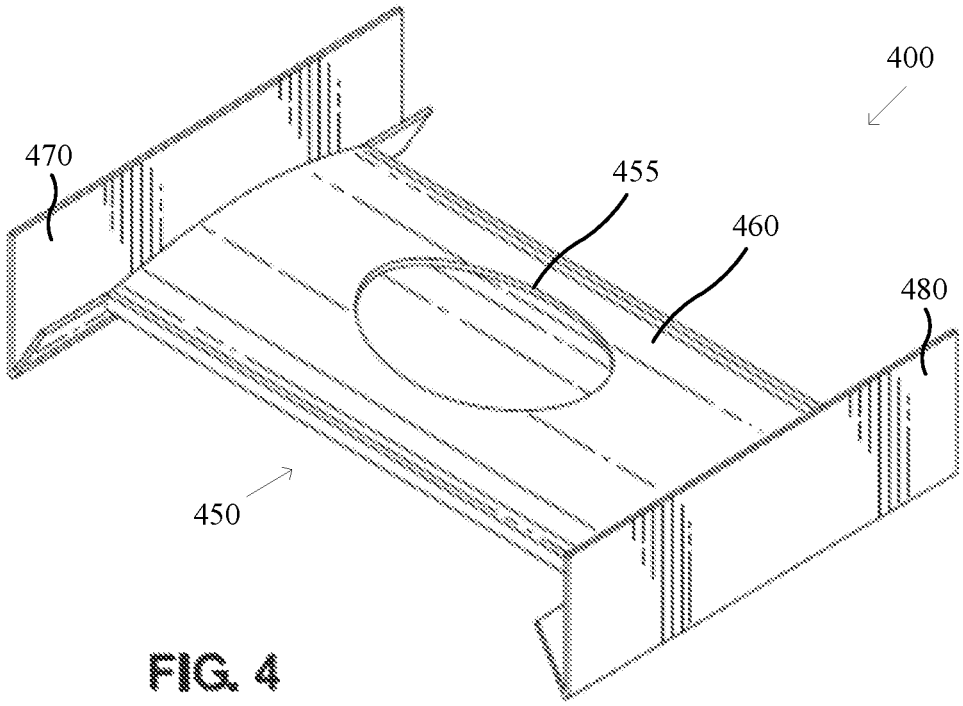
FIG. 4 shows a perspective view of a shipping system suspension unit, according to one implementation of the present disclosure.

FIG. 4 shows a perspective view of a shipping system suspension unit, according to one implementation of the present disclosure. Diagram 400 shows suspension insert 450 including product retention compartment 460 extending between suspension unit 470 and suspension unit 480. As shown in FIG. 4, product retention compartment 460 is a pillow pack design formed by a top section of product retention compartment 460 and a lower section of product retention compartment 460. The shape of product retention compartment 460 is a marquise shape formed by tension resulting from an overlapping seam on the bottom section of product retention compartment 460 pulling tension across the top section of product retention compartment 460 and causing the top section to bow upwards and the lower section to bow downwards, where upwards and indicate that the sections are curving or bowing away a center line of product retention compartment 460 extending through the creases on either side of the pillow pack. In some embodiments, product retention compartment 460 may include a marquise-shaped closure flap (not shown) hingedly connected to and extending from the lower section of product retention compartment 460. The marquise shaped closure flap may be rotated or folded into position to close the ends of product retention compartment 460 for retaining a product, such as a mobile phone, tablet computer, or other electronic device in product retention compartment 460 during shipping.

As shown in FIG. 4, suspension insert 450 includes portal 455. In some embodiments, portal 455 may be an opening cut in the upper section of suspension insert 450. In other embodiments, portal 455 may include a translucent or transparent covering to allow visibility into product retention compartment 460 without leaving a large opening in product retention compartment 460.

Figure 5:
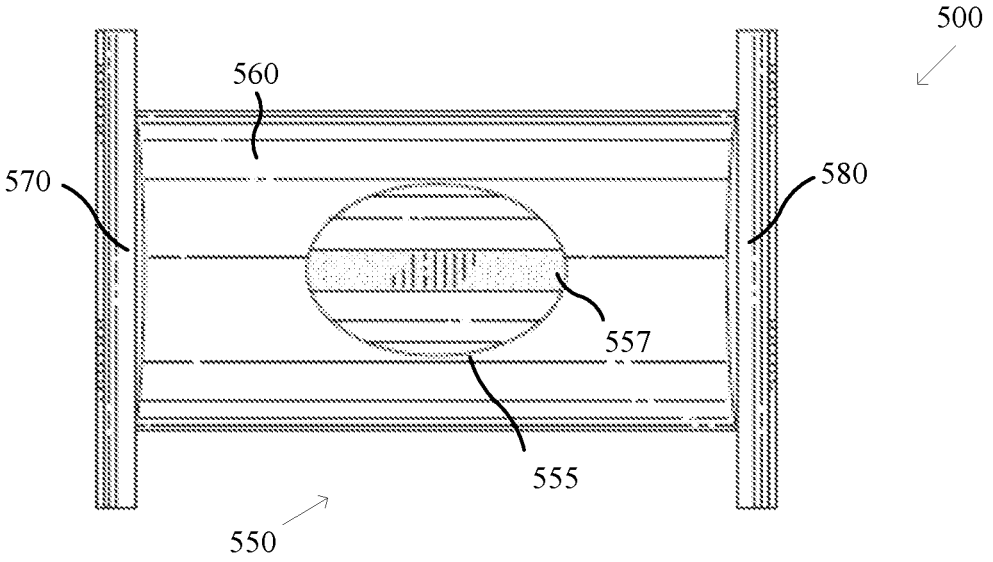
FIG. 5 shows a top view of the shipping system suspension unit of FIG. 4, according to one embodiment of the present disclosure.

FIG. 5 shows a top view of the shipping system suspension unit of FIG. 4, according to one embodiment of the present disclosure. Diagram 500 shows suspension insert 550 including product retention compartment 560, suspension unit 570, and suspension unit 580. As shown in FIG. 5, suspension unit 570 and suspension unit 580 are wider than the width of product retention compartment 560. In some embodiments, the width of suspension unit 570 and suspension unit 580 may be about as wide as the inner dimension of an outer carton used to ship a product held by suspension insert 550. Suspension insert 550 is shown with portal 555 in the top section through which a consumer may view a product contained in product retention compartment 560. As shown in FIG. 5, the view from the top of suspension insert 550 through portal 555 shows the bottom section of product retention compartment 560. A portion of seam 557 is shown, where seam 557 is an overlapping section of the material from which product retention compartment 560 is formed. In some embodiments, product retention compartment 560 may be formed form cardboard and seam 557 may be a seam held together by glue, tape, semi-permanent adhesive, permanent adhesive, radio-frequency (RF) welding, heat bond, locking closures, interlocking closures, stitching, or any other ways to attach or lock the seams.

In some embodiments, suspension insert 550 may be formed from a single blank, such as a single cardboard blank. Suspension insert 550 may be formed by cutting the blank allowing sections to be wrapped downwardly and connected at seam 557, providing the tension to give shape to product retention compartment 560. The closure flap for selectively closing product retention compartment 560 may be a folded flap extending from the bottom section of product retention compartment 560 or from a side section of product retention compartment 560. In some embodiments, the closure flap may be a section of the blank from which suspension insert 550 is formed that is finished to selectively close product retention compartment 560. In some embodiments, suspension unit 570 and suspension unit 580 may be formed from sections of the blank from which suspension insert 550 is formed finished to extend outwardly from the ends of product retention compartment 560 in an extendable manner, allowing the length of suspension insert 550 to vary based on an inward compression applied from the ends of suspension unit 570 and suspension unit 580 towards product retention compartment 560.

Figure 6:
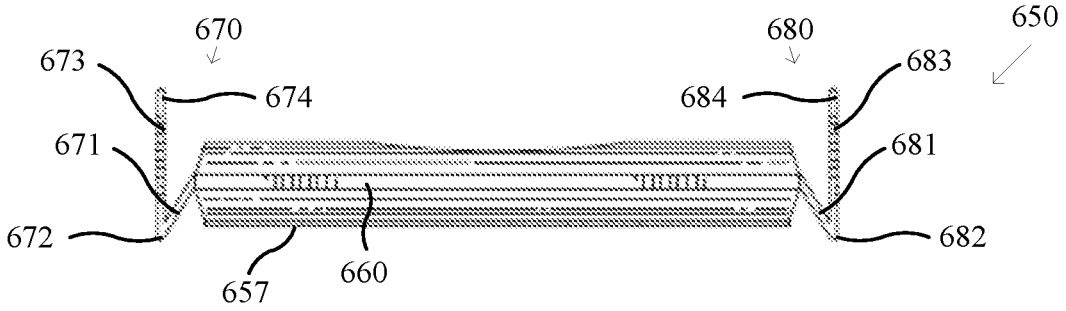
FIG. 6 shows a side view of the shipping system suspension unit of FIG. 4, according to one embodiment of the present disclosure.

FIG. 6 shows a side view of the shipping system suspension unit of FIG. 4, according to one embodiment of the present disclosure. As shown in FIG. 6, suspension unit 670 and suspension unit 680 extend above and below product retention compartment 660. The folded structure of suspension unit 670 and suspension unit 680 allow the length of suspension insert 650 to adjust to fit the length of an internal cavity of an outer container used to ship a product contained in product retention compartment 660. The folded structure allows suspension insert 650 to secure product retention compartment 660 in the outer container. As shown in FIG. 6, suspension unit 670 and suspension unit 680, when compressed towards product retention compartment 660 as they are when inserted into an outer container, extend above and below product retention compartment 660, allowing suspension insert to suspend product retention compartment 660 and any product contained therein in the outer container. Seam 657 is visible on the bottom side of suspension insert 650.

In some embodiments, the suspension insert may include a securing element. In some embodiments, the securing element may engage one or more of retention elements 125 and 127. The securing element may be a fold between first portion 671 and second portion 673 or the fold between first portion 681 and second portion 683 of the suspension units of the suspension insert. In some embodiments, lower supports 672 and 682 may rest on the base of outer carton 110 and upper supports 674 and 684 may engage the upper end of the cavity of outer carton 110 when outer carton 110 is closed. Thus, the supports extending between 672 and 674, and between 682 and 684, secure the securing insert in the height of outer carton 110. In other embodiments, the securing element by be a gap between an inner portion of the suspension units and an outer portion of the suspension units.

Figure 7:
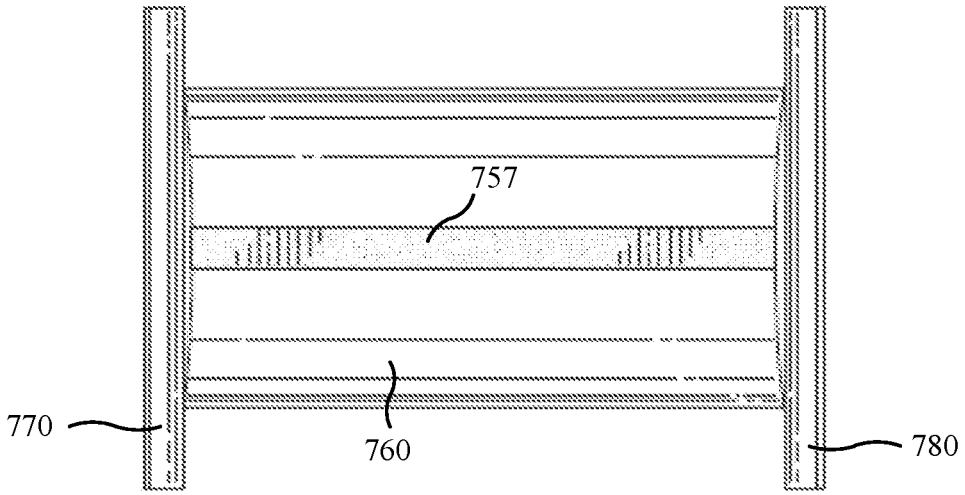
FIG. 7 shows a bottom view of the shipping system suspension unit of FIG. 4, according to one embodiment of the present disclosure.

FIG. 7 shows a bottom view of the shipping system suspension unit of FIG. 4, according to one embodiment of the present disclosure. As shown in FIG. 7, seam 757 extends the length of product retention compartment 760. The lower section of product retention compartment 760 is visible with suspension unit 770 and suspension unit 780 extending from either end of product retention compartment 760.

Figure 8:
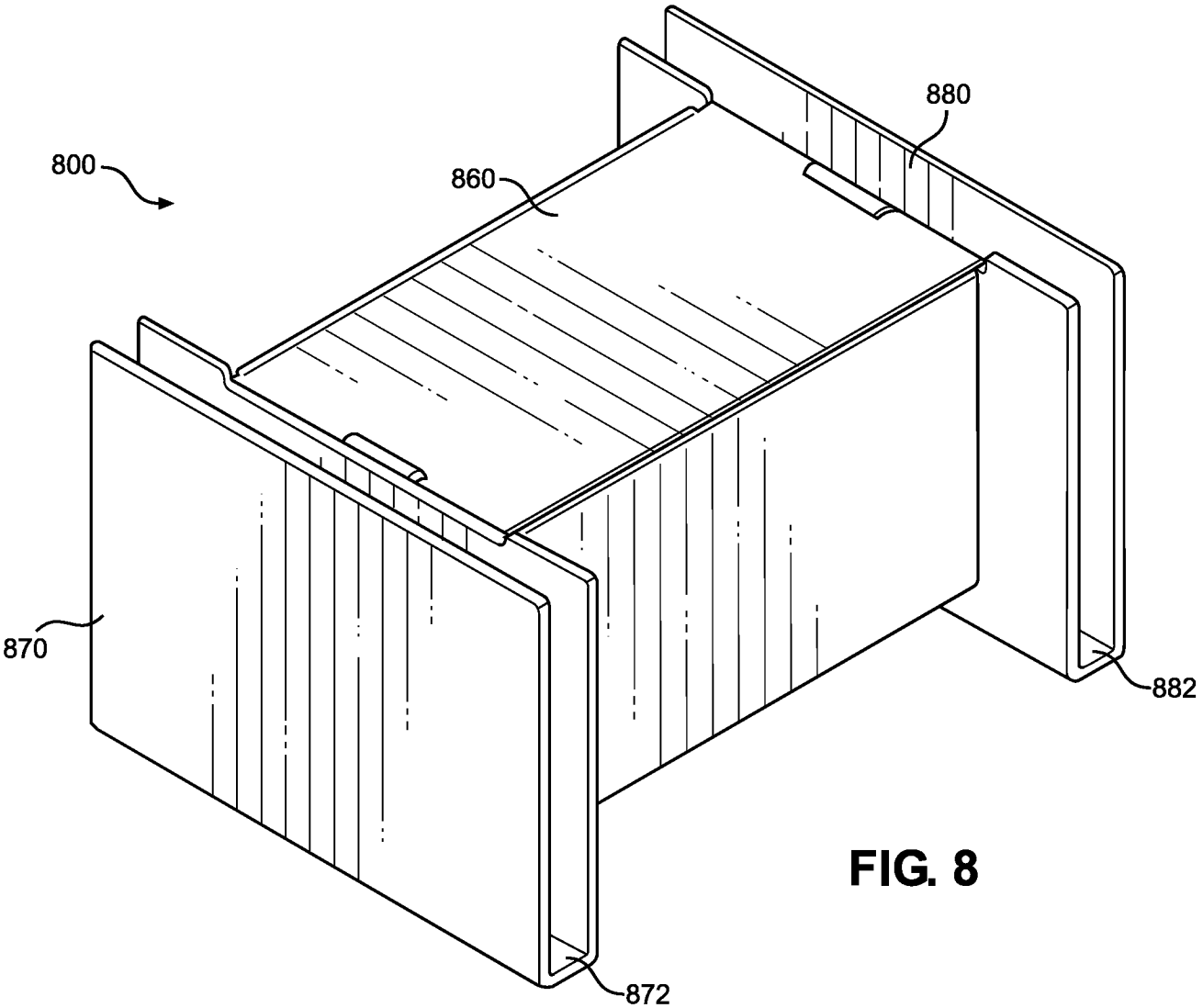
FIG. 8 shows a perspective view of another shipping suspension unit, according to one embodiment of the present disclosure.

FIG. 8 shows a perspective view of another shipping suspension unit, according to one embodiment of the present disclosure. Suspension insert 800 includes product retention compartment 860 extending between suspension unit 870 and suspension unit 880. As shown in FIG. 8, product retention compartment 860 is a rectangular compartment. In some embodiments, suspension unit 870 and suspension unit 880 may be hingedly connected to and extend from the upper section of product retention compartment 860. Suspension unit 870 and suspension unit 880 may be a part of the same blank from which product retention compartment 860 is formed. In such an embedment, suspension unit 870 and suspension unit 880 may be hingedly attached by a fold or folding joint at the edge of the upper section of product retention compartment 860. Suspension unit 870 and suspension unit 880 may be cut with tabs that, when the suspension units are configured for shipping, the tabs extent upward above the upper section of product retention compartment 860. In some embodiments, an additional upper support tab may be cut in the middle of the folding edge joining suspension unit to product retention compartment 860. In such an embodiment, the tabs extent upward from product retention compartment 860 to fill the height of the inner cavity of an outer container, leaving a gap between the outer container and the upper side of product retention compartment 860.

As shown in FIG. 8, suspension unit 870 includes accessory storage section 872 and suspension unit 880 includes accessory storage section 882. The accessory storage sections may be formed by folding components of the suspension units to create a space between the ends of product retention compartment 860 and the internal ends of the outer container. In some embodiments, the accessory storage sections may be used to include accessories such as cables, power cords, remote controls, and other accessories to a product that may be shipped in product retention compartment 860. Accessory storage section 872 and accessory storage section 882 may function as the securing elements of suspension insert 800.

Figure 9:
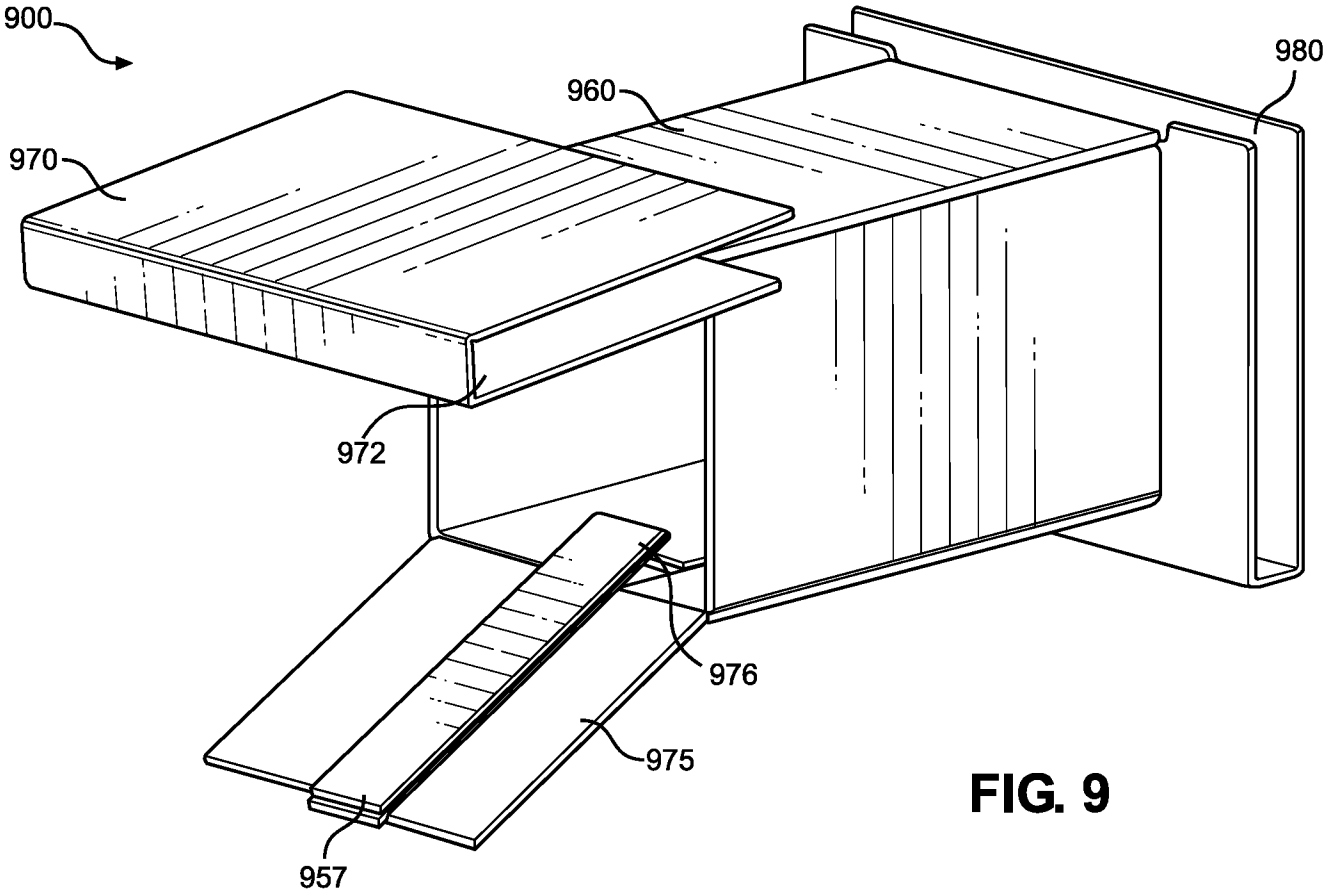
FIG. 9 shows another view of the shipping suspension unit of FIG. 8, according to one embodiment of the present disclosure.

FIG. 9 shows another view of the shipping suspension unit of FIG. 8, according to one embodiment of the present disclosure. Suspension insert 900 is shown with one end of product retention compartment 960 open. Suspension insert 900 includes product retention compartment 960 extending between suspension unit 980 and suspension unit 970 which is shown in an open configuration. As shown in FIG. 9, suspension unit 970 is raised to uncover the end of product retention compartment 960. Selectively closable flap 975 may be a selectively closable flap that may be rotated from an open position, as shown, to a closed position substantially covering the open end of product retention compartment 960. In some embodiments, suspension unit 970 may maintain accessory storage section 972 when suspension unit 970 is in an open position, a closed position, or being transitioned between the open and closed positioned. In some embodiments, both ends of suspension insert 900 may be configured the same such that the end of product retention compartment 960 closed by suspension unit 980 is a mirror image of the end closed by suspension unit 970.

In some embodiments, the selectively closable flap 975 is hingedly attached to the lower section of product retention compartment 960. As shown in FIG. 9, selectively closable flap 975 includes additional structural support element 976 cut out of the lower section of product retention compartment 960. Additional structural support element 976 may be configured to rotate downwardly to create an additional lower support to suspension insert 900 when selectively closable flap 975 is hingedly rotated upward to a closed configuration. Additional structural support element 976 may extend downwardly to the base of the outer container. Thus, when suspension insert 900 is in the closed configuration and installed in an outer container, suspension insert 900 may secure product retention compartment 960 in the length, width, and height of the outer container with an air cushion or physical gap between the top, bottom, and all sides of product retention compartment 960 and the outer container.

Additional structural support element 976 may add additional structural support to the system, strengthening the system in a downward direction securing the product retention compartment in the outer container. In some embodiments, additional structural support element 976 may be a tab cut into the lower section of product retention compartment 960. Additional structural support element 976 may be cut to include seam 957 connecting the flaps of the single blank from which suspension insert 900 is formed. By including seam 957, additional structural support element 976 may provide even more additional structural support.

Figure 10:
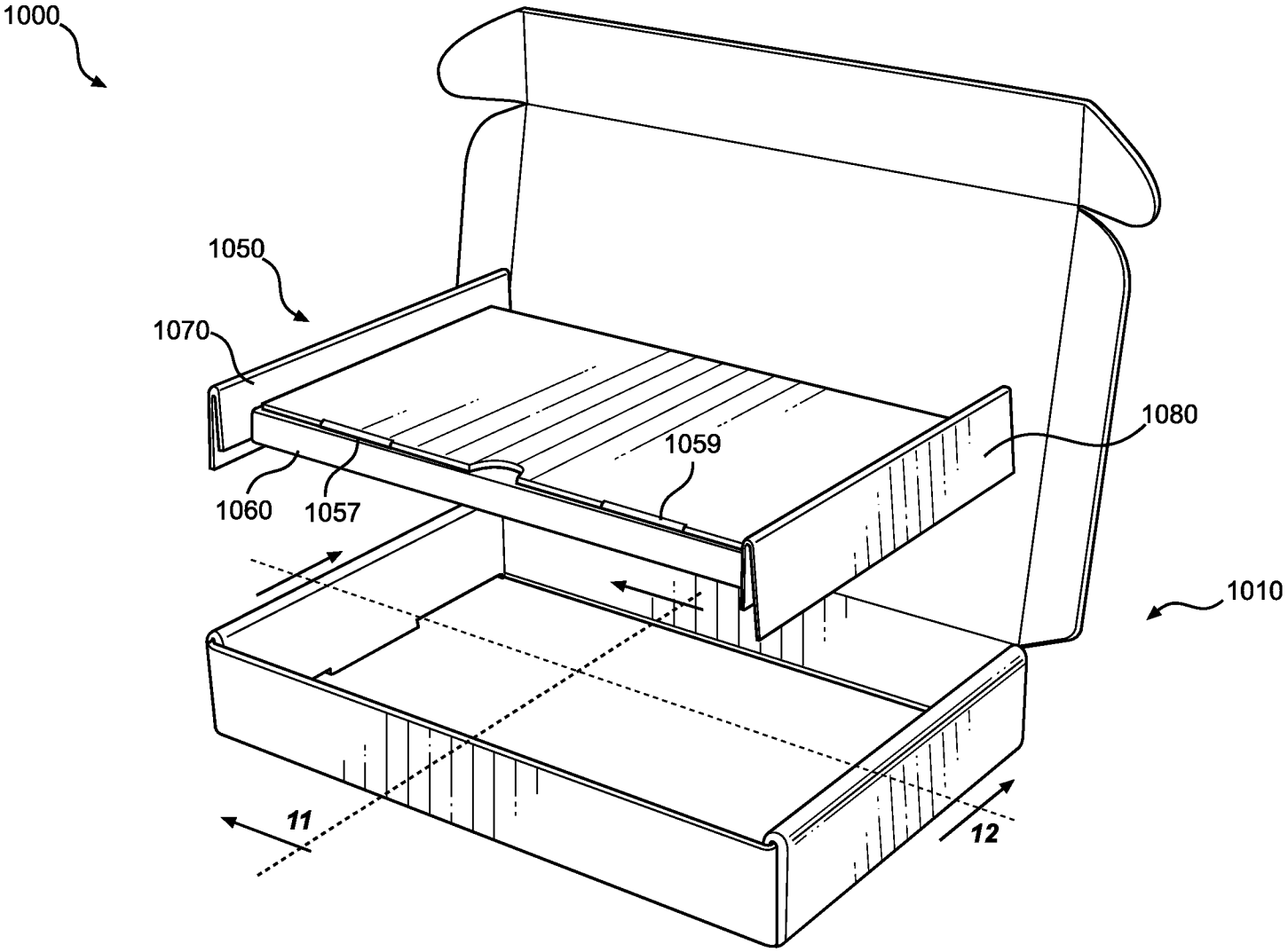
FIG. 10 shows an exploded view of another shipping container system, according to one embodiment of the present disclosure.

FIG. 10 shows an exploded view of another shipping container system, according to one embodiment of the present disclosure. Packaging system 1000 shows outer container 1010 and inner compartment 1050. As shown in FIG. 10, inner compartment 1050 includes product retention compartment 1060, the top of which is secured in place with locking tabs 1057 and 1059 inserted into receiving slots. By securing the top of product retention compartment 1060 with locking tabs 1057 and 1059, inner compartment 1050 may be formed from a single blank and constructed without the use of any glue or adhesive. By forming each component of packaging system 1000 from an eco-friendly material, such as corrugated cardboard, and securing the containers and compartments with folds and retention tabs, packaging system 1000 may be a recyclable and non-toxic packaging solution.

Inner compartment 1050 includes suspension element 1070 extending from one end of product retention compartment 1060 and suspension element 1080 extending form the other end of product retention compartment 1050. In some embodiments, when inner compartment 1050 is inserted into outer container 1010, suspension elements 1070 and 1080 secure inner compartment 1050 in the width of outer container 1010, secure inner compartment 1050 in the length of outer container 1010, and secure inner compartment 1050 in the height of outer container 1010.

Figure 11:
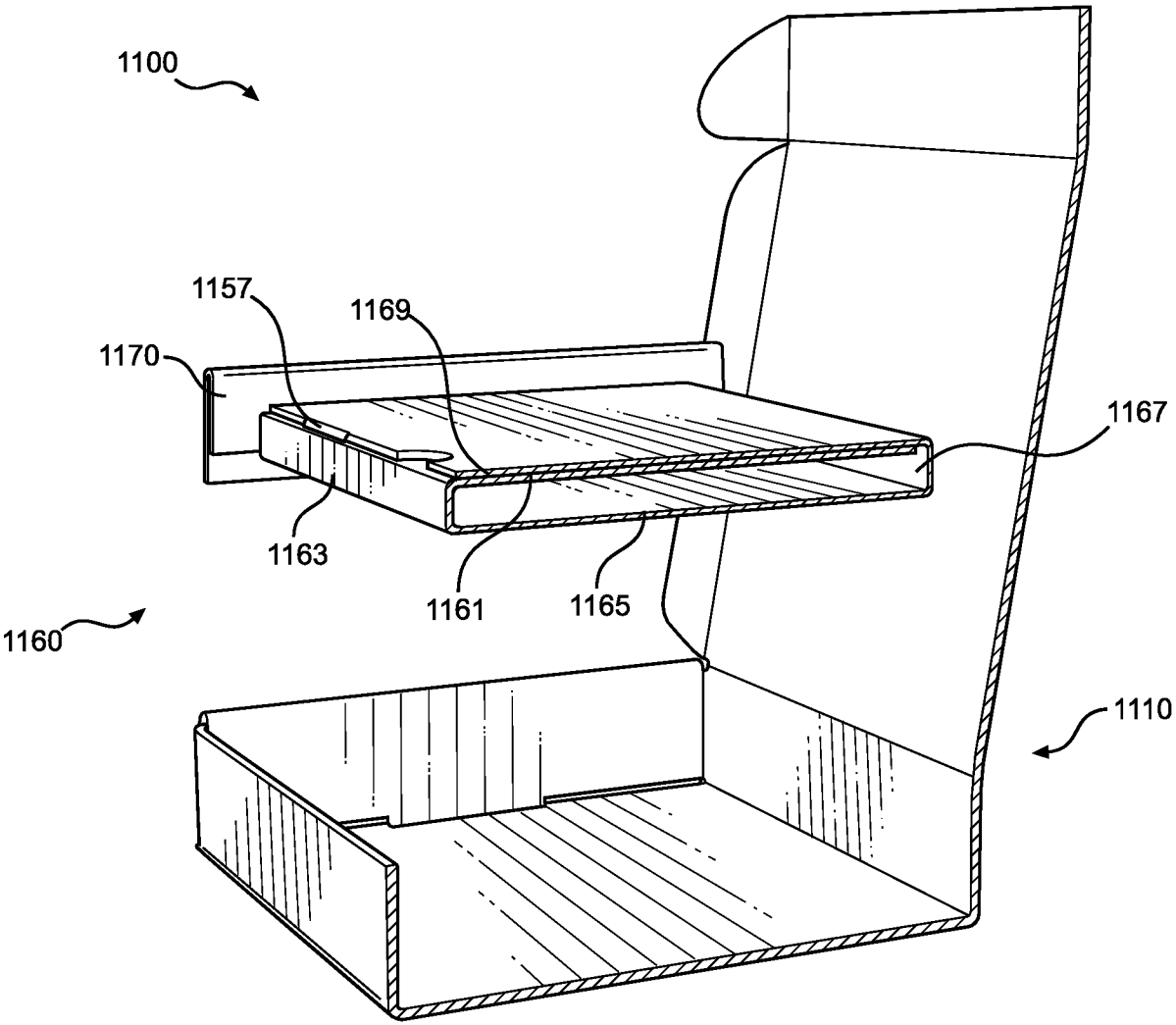
FIG. 11 shows a cross section of the shipping container system of FIG. 10, according to one embodiment of the present disclosure.

FIG. 11 shows a cross section of the shipping container system of FIG. 10, according to one embodiment of the present disclosure. As shown in FIG. 11, product retention compartment 1160 includes one sheet of material forming an inner top extending downward form an upper front fold to form a front panel, extending rearward from a lower front fold to form a bottom, extending upward from a lower rear fold to form a rear panel, and extending forward to form an outer top. As shown in FIG. 11, the outer top is secured into a slot in the upper front fold allowing securing tab 1157 to be held in place and extend downward into the cavity of product retention compartment 1160 just behind the front panel.

Figure 12:
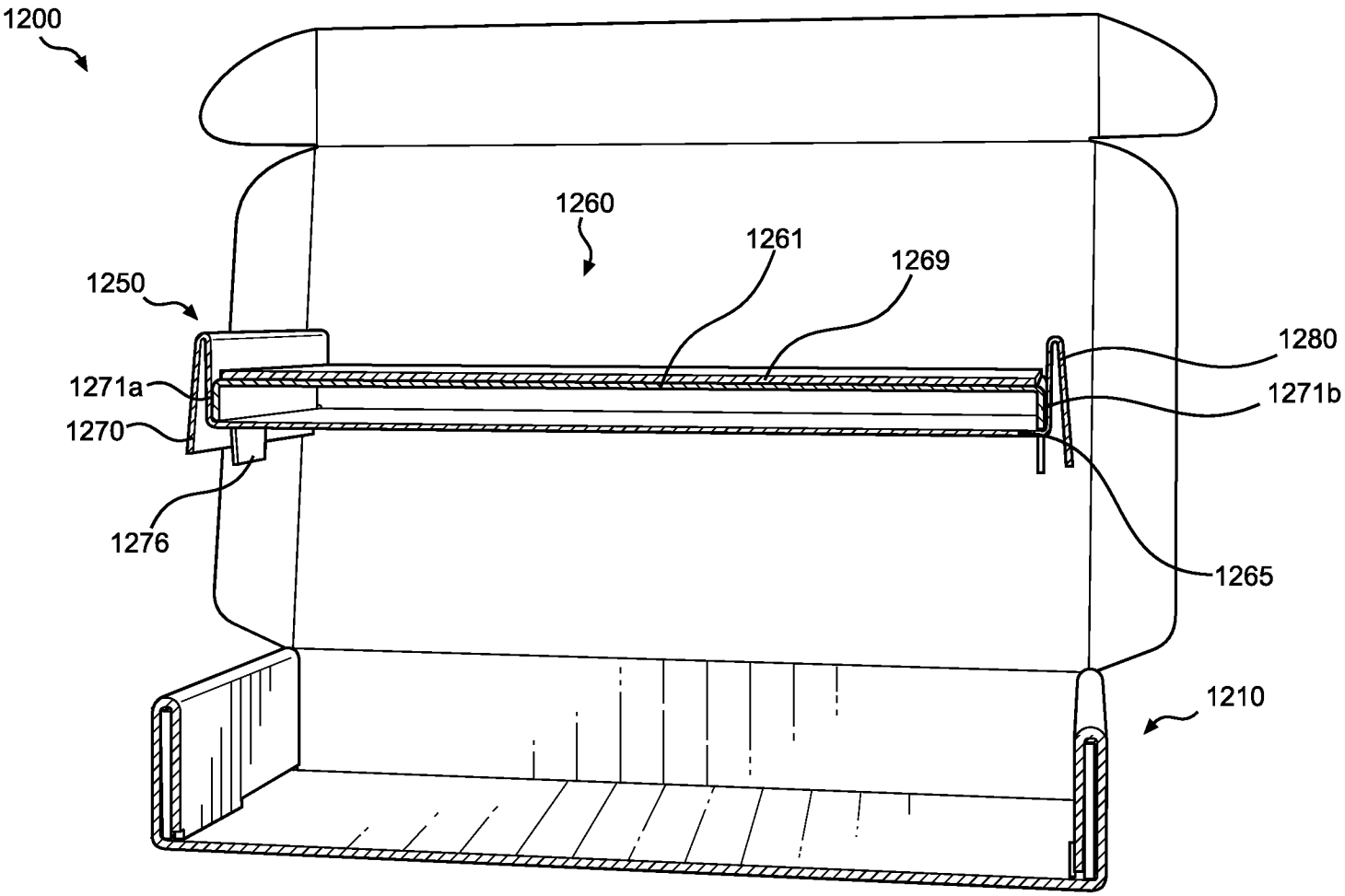
FIG. 12 shows another cross section of the shipping container system of FIG. 10, according to one embodiment of the present disclosure.

FIG. 12 shows another cross section of the shipping container system of FIG. 10, according to one embodiment of the present disclosure. As shown in FIG. 12, packaging system 1200 shows outer container 1210 and inner compartment 1250. Inner compartment 1250 includes suspension elements 1270 and 1280, extending from opposite ends of inner compartment 1250. In some embodiments, suspension elements 1270 and 1280 may include folded structure to allow for lateral expansion and contraction in the length of inner compartment 1250 to accommodate variances in the dimensions of outer container 1210. The height of suspension elements 1270 and 1280 may provide security for inner compartment 1250 in the height of outer container 1210. As shown in FIG. 12, inner compartment 1250 includes structural support element 1276 extending below bottom 1265 of product retention compartment 1260. Structural support element 1276 may provide support for product retention compartment 1260 to maintain an air gap between the bottom of outer container 1210 and product retention compartment 1260.

As shown in FIG. 12, inner compartment 1250 has opposing sides 1271*a* and 1271*b* formed by a folded flap extending from inner top 1261. In some embodiments, structural support element 1276 may be formed by a tab extending from side 1271*a* or 1271*b* through a receiving slot in bottom 1265. The receiving slot may secure structural support element 1276 in place.

Figure 13:
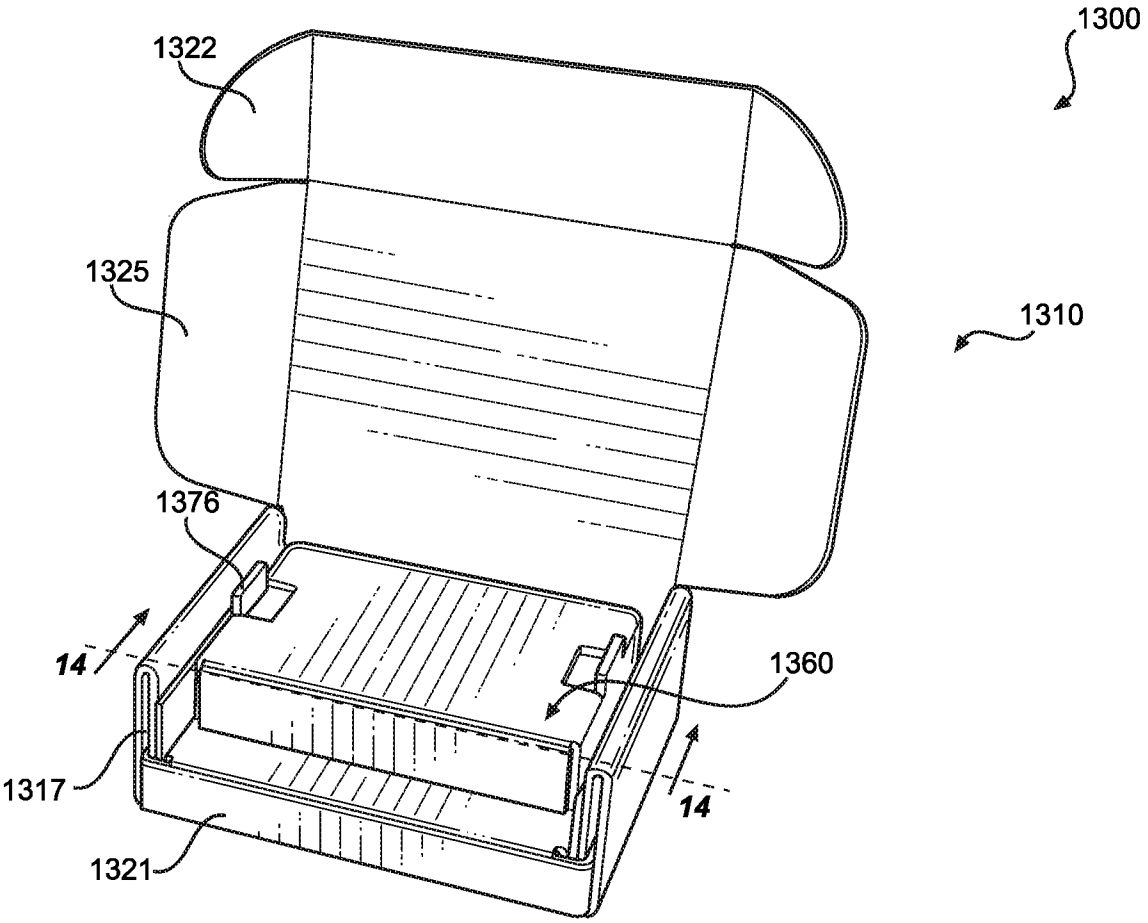
FIG. 13 shows diagram of another shipping container system, according to one embodiment of the present disclosure.

FIG. 13 shows diagram of another shipping container system, according to one embodiment of the present disclosure. Packaging system 1300 includes outer container 1310 and product retention compartment 1360. As shown in FIG. 13, outer container 1310 includes closing flap 1325, securing tab 1322, and securing slot 1317. When outer container 1310 is configured in a closed configuration, closing flap 1325 may fit inside the end of outer container 1310 and securing tab 1322 may fit in securing slot 1317. Product retention compartment 1360 may include structural support element 1376 extending upward to maintain the air gap between outer container 1310 and product retention compartment 1360 when packaging system 1300 is in a closed configuration. In some embodiments, outer container 1310 and product retention compartment 1360 may be formed from a single blank. Packaging system 1300 may be formed from a single piece of material cut and folded to create outer container 1310 including and containing product retention compartment 1360. In some embodiments, product retention compartment 1360 may be suspended with an air gap above, below, and beside each side of product retention compartment 1360. This may allow for secure shipping and storage of fragile products and expensive products. In some embodiments, product retention compartment 1360 may have suspension elements extending to the inner walls of the volume defined by outer container 1310 in a closed configuration. The suspension elements may provide structural support to maintain an air gap between the top, bottom, sides, and ends of product retention compartment 1360 and outer container 1310. As shown in FIG. 13, front panel 1321 is a partial front of outer container 1310.

Figure 14:
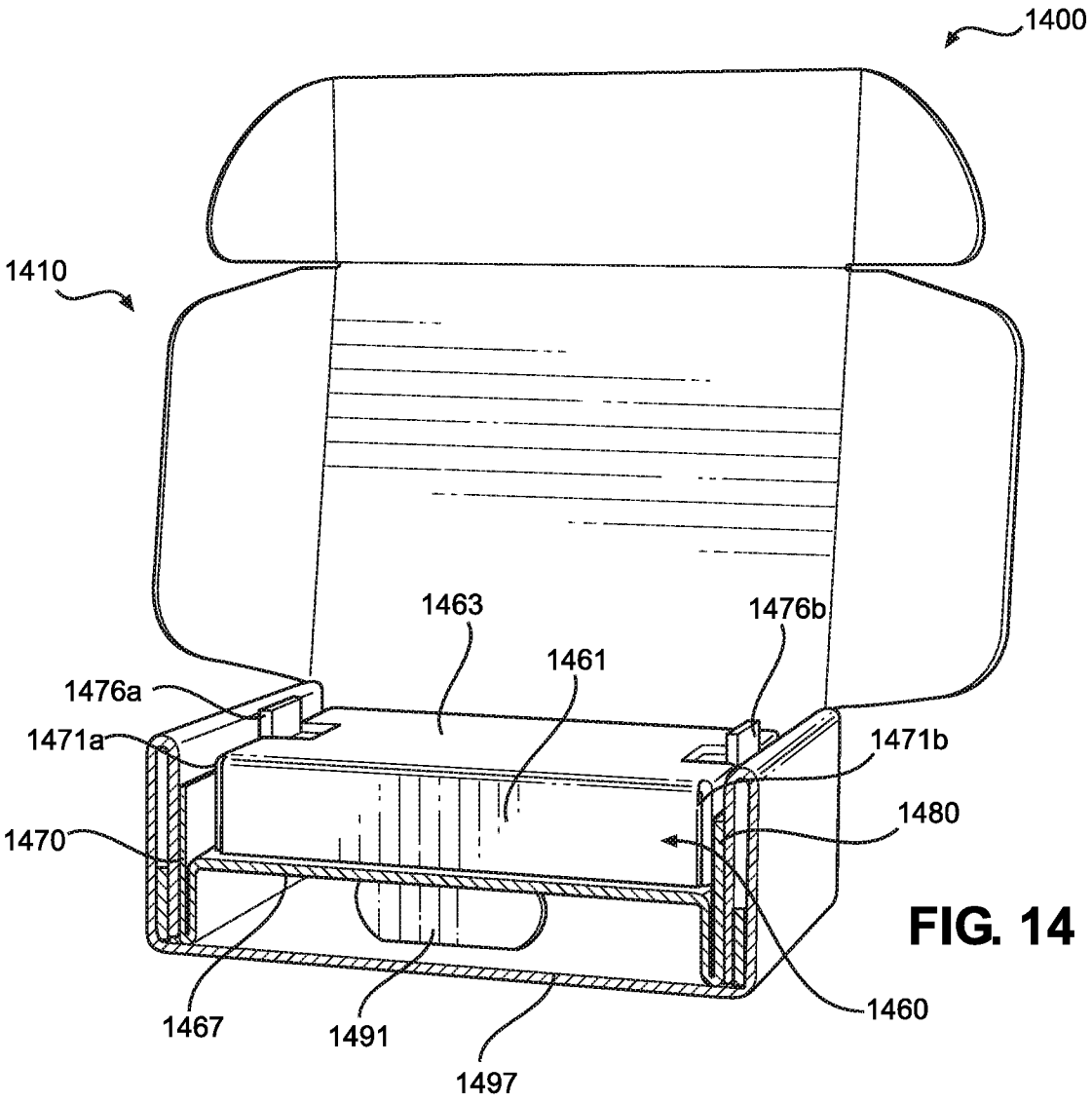
FIG. 14 shows a cross section of the shipping container system of FIG. 13, according to one embodiment of the present disclosure.

FIG. 14 shows a cross section of the shipping container system of FIG. 13, according to one embodiment of the present disclosure. Packaging system 1400 includes product retention compartment 1460 enclosed in outer container 1410. Tab 1491 extends form inner compartment front 1461 through a receiving slot in inner compartment bottom layer 1467. Inner compartment front 1461 extends upwards and is folded and continues forming inner compartment top 1463 extending backwards and folding downwards forming inner compartment back (not shown), which, in turn, extends down and folds to form inner compartment bottom layer 1467 which extends forward past inner compartment front 1461. In some embodiments, inner compartment bottom layer 1467 may include a receiving slot for receiving tab 1491. Tab 1491 may be a suspension element supporting product retention compartment 1460 and maintaining the air gap between the bottom of outer container 1410. The single-blank formation of packaging system 1400 may continue with inner compartment bottom layer 1467 extending forward past inner compartment front 1461 and folding to form outer container 1410.

As shown in FIG. 14, packaging system 1400 includes suspension elements 1476*a* and 1476*b* extending upwards above inner compartment top 1463. Suspension elements 1476*a* and 1476*b* may be tabs cut from inner compartment top 1463 that, when inner compartment end 1471*a* and inner compartment end 1471*b* are folded into place, extend to maintain the air gap between inner compartment 1460 and outer container 1410 when packaging system 1400 is arranged in a closed configuration. In some embodiments, the air gap between product retention compartment 1460 and the bottom of outer container 1410 may be maintained by suspension elements 1470 and 1480. Suspension elements 1470 and 1480 may extend from inner compartment bottom layer 1467. In some embodiments, inner compartment bottom layer 1467 extend past the length of product retention compartment 1460 to form an air gap between product retention compartment 1460 and outer container 1410. Suspension elements 1470 and 1480 may be formed from extensions of inner compartment bottom layer 1467 and may fold down towards the bottom of outer container 1410 before being folded again in an accordion-style fold extending upwards past inner compartment bottom layer 1467.

In some embodiments, suspension elements 1470 and 1480 may include a down-up accordion fold, allowing suspension elements 1470 and 1480 to extend and contract to accommodate an inner compartment of different sizes. In other embodiments, the extension and accordion fold configuration may extend beyond the length of product retention compartment 1460 and then fold up before accordion-folding down. Suspension elements 1470 and 1480 may extend and fit snuggly against the inner side of the end walls of outer container 1410. In some embodiments, the end walls of outer container 1410 may be constructed by end wall flaps extending outward from the bottom layer of outer container 1410 and folding over end wall tabs extending from the front and back panels of outer container 1410.

Figure 15:
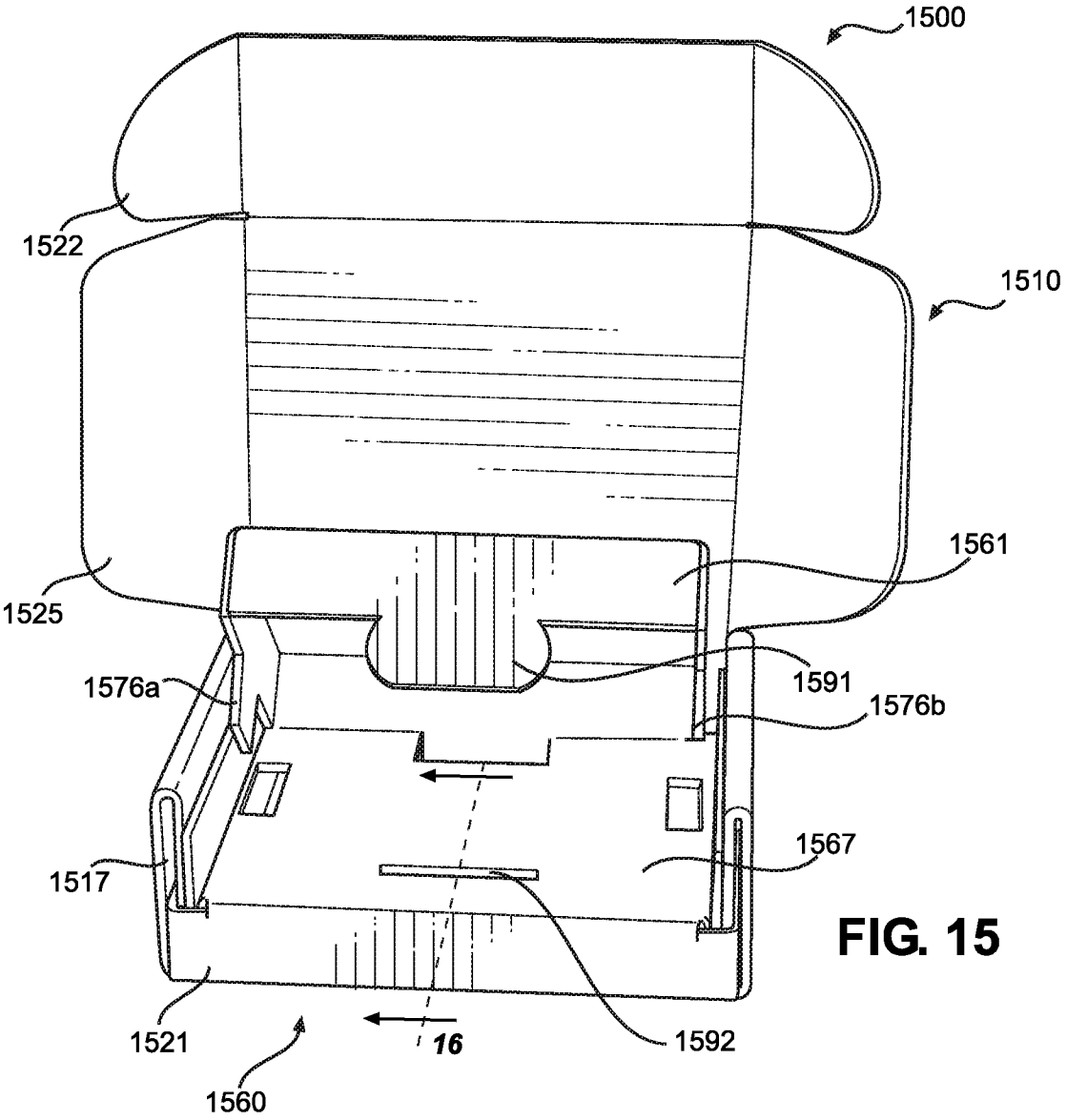
FIG. 15 shows another diagram of the shipping container system depicted in FIG. 13 in an open configuration, according to one embodiment of the present disclosure.

FIG. 15 shows another diagram of the shipping container system depicted in FIG. 13 in an open configuration, according to one embodiment of the present disclosure. Packaging system 1500 is shown with outer container 1510 in an open configuration and product retention compartment 1560 in an open configuration. As shown in FIG. 15, product retention compartment 1560 includes structural support elements

1576*a* and 1576*b* extending downwards from the end walls of product retention compartment 1560 and tab 1591 extending downwards from inner compartment front panel 1561, and each having a corresponding receiving slot 1592 in inner compartment bottom layer 1567. As shown in FIG. 15, when packaging system 1500 is arranged in a closed configuration, closing flap 1525 may fit between the end wall of product retention compartment 1560 and the end wall of outer compartment 1510. In some embodiments, securing tab 1522 may be inserted into securing slot 1517.

Figure 16:
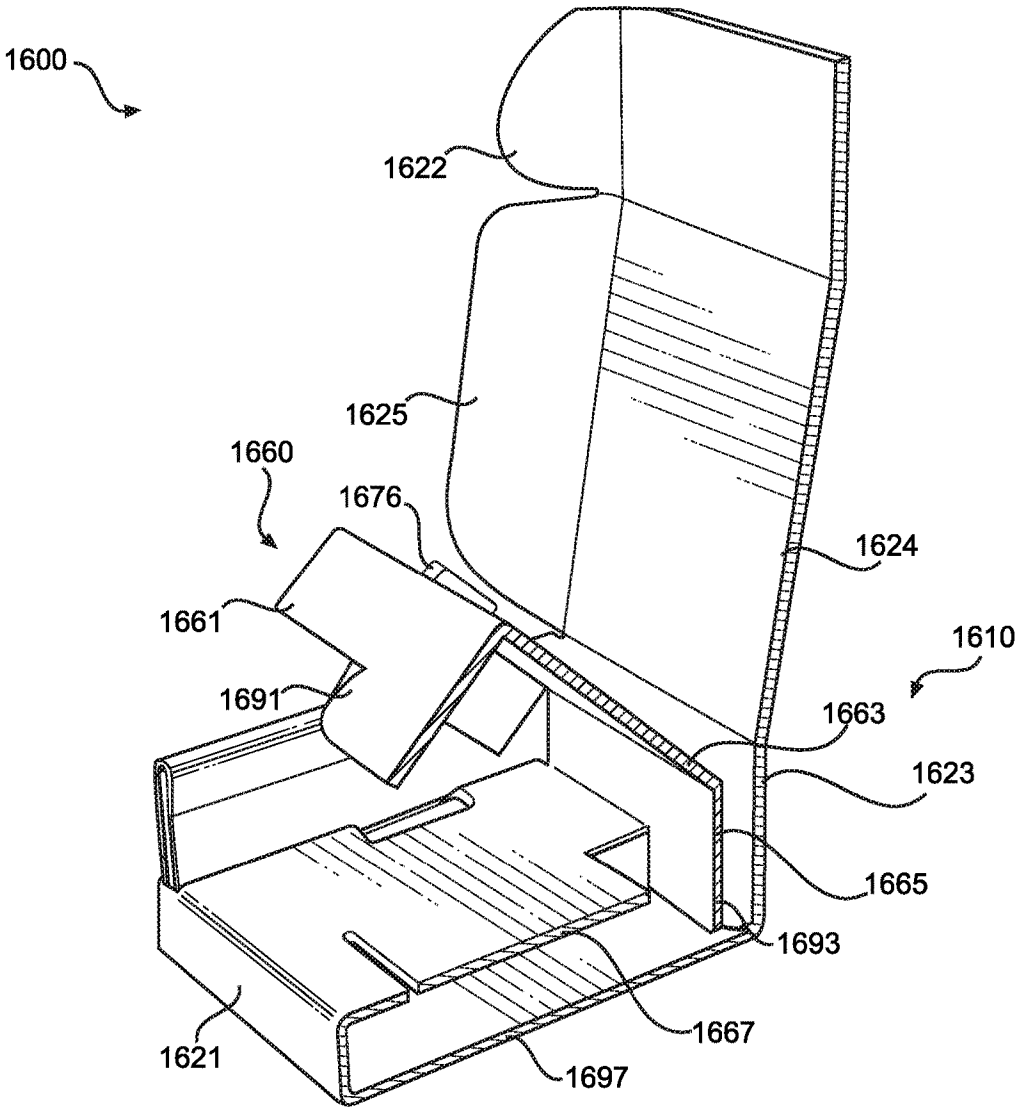
FIG. 16 shows a cross section of the shipping container system as shown in FIG. 15, according to one embodiment of the present disclosure.

FIG. 16 shows a cross section of the shipping container system as shown in FIG. 15, according to one embodiment of the present disclosure. As shown in FIG. 16, packaging system 1600 includes product retention compartment 1660 and outer container 1610 folded from a single piece of material. The cross section shows the continuous material extending from tab 1691 to form the front 1661, top 1663, back 1665, and bottom 1667 of product retention compartment 1460. As shown in FIG. 16, the single piece of material is used to form support tab 1693, structural support element 1676. The single piece of material used to form packaging system 1600 extends past front 1661 to form partial front panel 1621 of outer container, outer container bottom 1697, outer container back 1623, outer container top, closing flap 1625, and securing tab 1622. The same single piece of material may also form the end walls of outer container 1610 with end wall tabs extending from partial front panel 1621 and back 1623 with end-wall flaps extending from bottom 1697 and being folded up and over the end wall tabs to form the upstanding end walls of outer container 1610.

Figure 17:
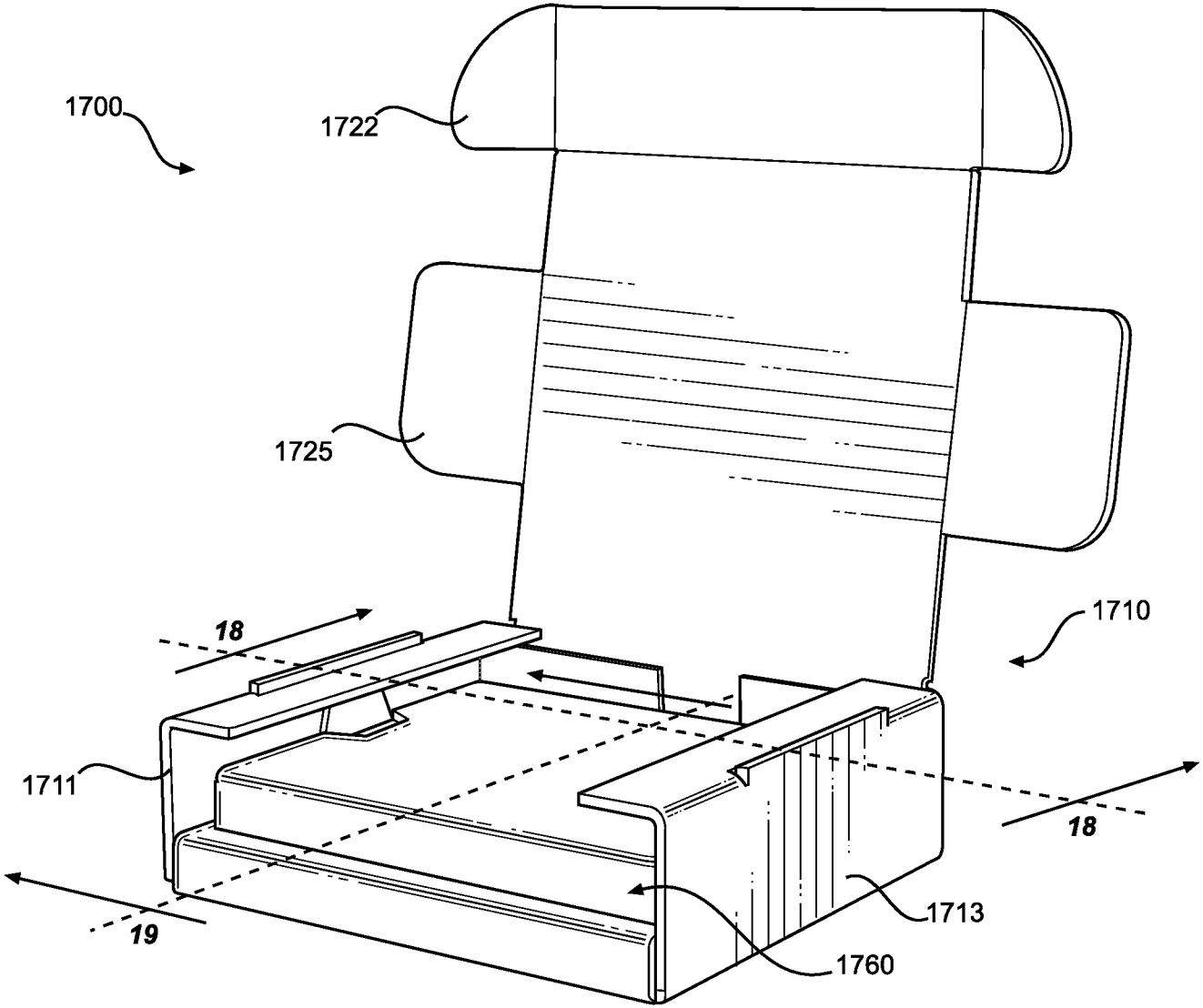
FIG. 17 shows diagram of another shipping container system, according to one embodiment of the present disclosure.

FIG. 17 shows diagram of another shipping container system, according to one embodiment of the present disclosure. Packaging system 1700 includes outer container 1710 and inner compartment 1760. As shown in FIG. 17, outer container 1710 includes closing flap 1725 and securing tab 1722. When outer container 1710 is configured in a closed configuration, closing flap 1725 may be inserted into a retention slot on the top side of the end of outer container 1710 and securing tab 1722 may slide between the end of outer container 1710 and the folded platform supporting inner compartment 1760. In some embodiments, a single piece of material may be used to form packaging system 1700. The single piece of material may also form the end walls of outer container 1710 with end wall tabs extending from end wall 1711 and end wall 1713 extending from bottom the bottom panel of outer container 1710 and being folded up to form the upstanding end walls 1711 and 1713 of outer container 1710.

Figure 18:
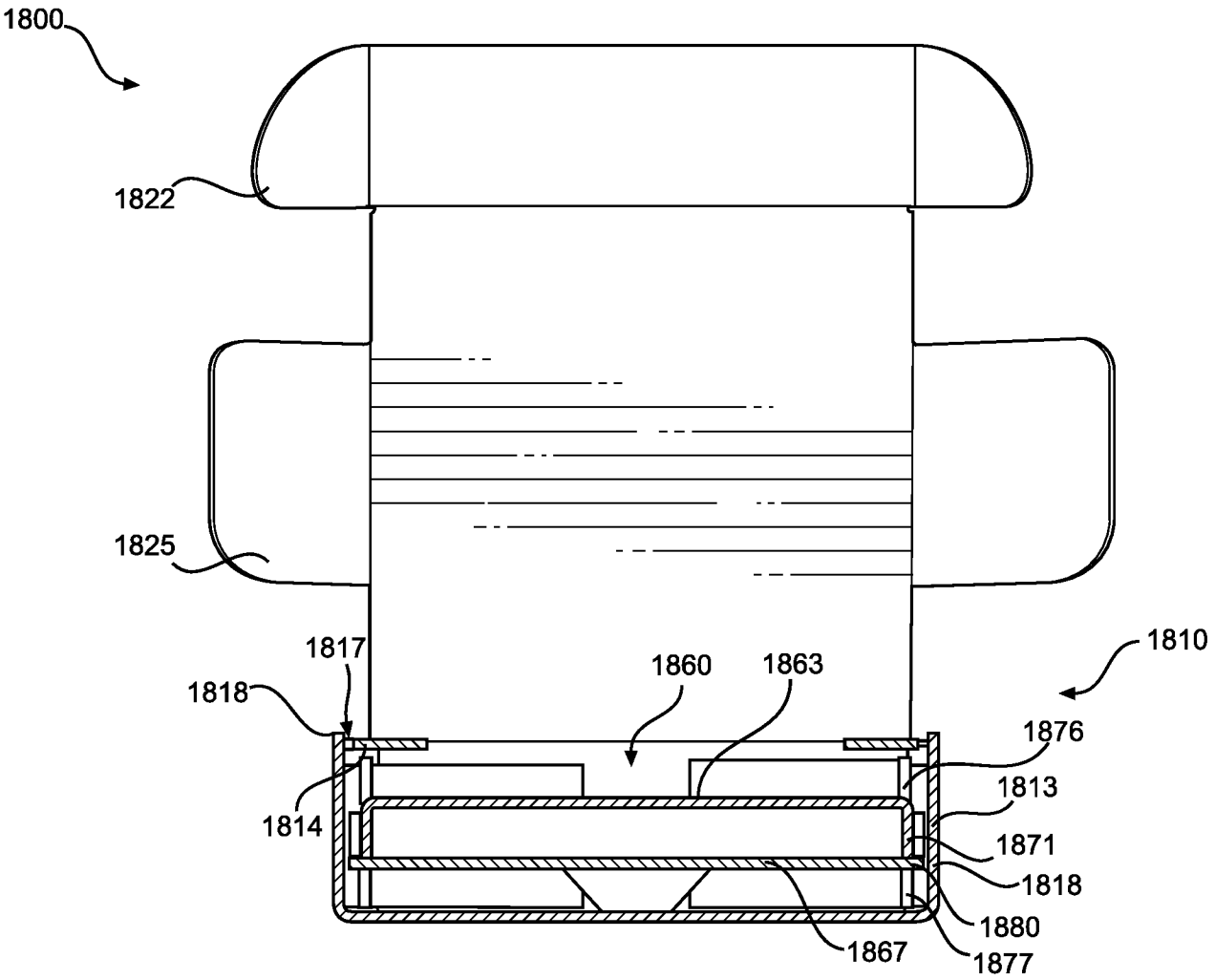
FIG. 18 shows a cross section of the shipping container system of FIG. 17, according to one embodiment of the present disclosure.

FIG. 18 shows a cross section of the shipping container system of FIG. 17, according to one embodiment of the present disclosure. In some embodiments, outer container 1810 and inner compartment 1860 may be formed from a single blank. Packaging system 1800 may be formed from a single piece of material cut and folded to create outer container 1810 including and containing inner compartment 1860. In some embodiments, inner compartment 1860 may be suspended with an air gap above, below, and beside each side of inner compartment 1860. This may allow for secure shipping and storage of fragile products and expensive products.

As shown in FIG. 18, packaging system 1800 includes structural support element 1876 extending upward to maintain the air gap above inner compartment 1860 inside outer container 1810, and support element 1877 extending downward below inner compartment 1860 to maintain the air gap below inner compartment 1860 and inside outer container 1810, when packaging system 1800 is in a closed configuration.

As shown in FIG. 18, packaging system 1800 includes outer container 1810 includes a base, a top, and walls extending from the base to the top defining a volume. When packaging system 1800 is in a closed configuration, closure flap 1825 inserts into receiving slot 1817, and securing tab 1822 may be inserted into securing slot 1818 formed between securing element 1880 extending from inner compartment bottom 1867 of inner compartment 1860 and end wall 1813. Outer container 1810 may include closure elements extending inward into the cavity of outer container 1810, such as closure element 1814. The closure elements may assist in securing the closure flaps in place when outer container 1810 is in the closed configuration.

In some embodiments, securing element 1880 extends past end wall 1871 of inner compartment 1860. The end walls of inner compartment 1860, including end wall 1871, may be made from extensions of inner compartment top 1863 folded down to meet inner compartment bottom 1867.

Figure 19:
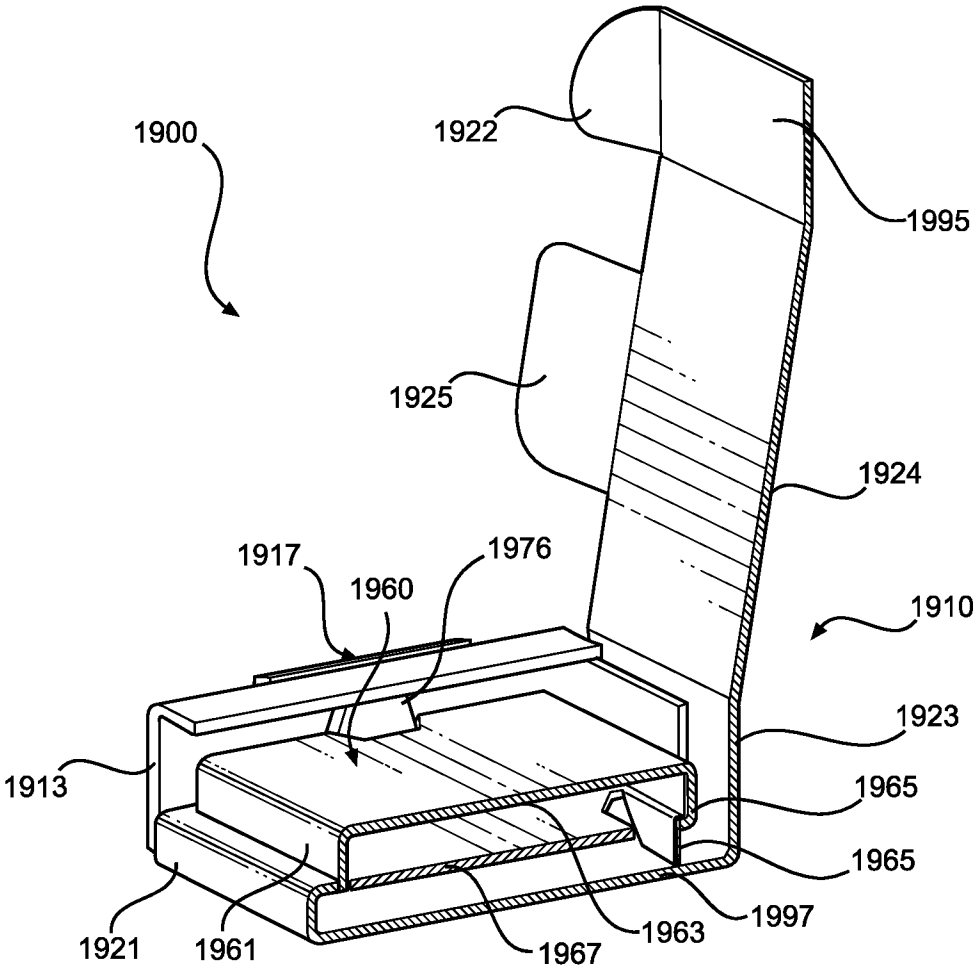
FIG. 19 shows another diagram of the shipping container system depicted in FIG. 17 in an open configuration, according to one embodiment of the present disclosure.

FIG. 19 shows another diagram of the shipping container system depicted in FIG. 17 in an open configuration, according to one embodiment of the present disclosure. As shown in FIG. 19, packaging system 1900 may be formed form a single piece of packaging container material. The single piece of packaging material may form inner compartment front 1961 and, including a fold and change in the direction which the material extends, continue to form inner compartment top 1963, inner compartment back 1965, inner compartment bottom 1967, outer container partial front 1921, outer container bottom 1997, outer container back 1923, outer container top 1924, and outer container front panel 1991. In some embodiments, the single piece of packaging container material may fold to form end walls of outer container 1910, including end wall 1913, and end walls of inner compartment 1960.

Packaging system 1900 may include various tabs, support elements, and retention slots for providing integrity to packaging system 1900. For example, packaging system 1900 may include securing tab 1922 for retention of outer compartment front panel 1995 in a closed configuration, closure flap 1925 for retention in receiving slot 1917, structural support elements 1976 and other structural support elements for maintaining the air gap between outer container 1910 and inner compartment 1960 when packaging system 1900 is in a closed configuration.

From the above description, it is manifest that various techniques can be used for implementing the concepts described in the present application without departing from the scope of those concepts. Moreover, while the concepts have been described with specific reference to certain implementations, a person having ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

What is claimed is:

1. A packaging system including:

an outer container having an outer container bottom, four upstanding sidewalls defining an outer container volume, the four upstanding walls including an outer container front, an outer container back, and two opposing outer container ends, the four upstanding walls bounding a perimeter of the outer container bottom, the outer container further comprising an outer container top, wherein the outer container top overlays an aperture formed by the upper sides of each of the four upstanding walls opposite the outer container bottom when the outer container is in a closed configuration, wherein the two opposing outer container ends are formed by end wall panels extending from the outer container bottom panel, the end wall panels are folded upwards from the outer container bottom panel towards the top end of the upstanding walls of the outer container, folded over a corresponding pair of end wall tabs, folded downward towards the bottom of the outer container, an end wall panel securing tab extending from a terminal end of the end wall tab, the end wall panel securing tabs being secured in place by an end wall panel securing slot in the outer container bottom; and an inner compartment having an inner compartment bottom, four upstanding inner compartment sidewalls including an inner compartment front, an inner compartment back, and two opposing inner compartment ends, the four upstanding inner compartment sidewalls bounding a perimeter of the inner compartment bottom, and an inner compartment top, wherein the inner compartment is formed by an inner compartment panel folded to form the inner compartment bottom, the four upstanding inner compartment sidewalls and the inner compartment top;

wherein the packaging system includes a plurality of suspension elements maintaining an air gap between the outer container and the inner compartment, and wherein the outer container and the inner compartment are formed from a packaging system material, wherein the packaging system material is one of a corrugated board, a paper board, a flexible plastic, a foamed plastic, a rigid plastic, and a corrugated plastic; and wherein the portion of the packaging system material forming the inner compartment bottom extends beyond each of the opposing inner compartment ends forming a pair of folding suspension elements extending from each end of the inner compartment, and wherein each of the folding suspension elements folds such that the portion of the folding suspension element proximate to the inner compartment extends in a first direction substantially perpendicular to a plane of the inner compartment bottom to an accordion fold further extending the terminal portion of the folding suspension element in a second direction past the inner compartment, creating an upper and lower suspension element maintaining an upper air gap above the inner compartment and a lower air gap below the inner compartment when the inner compartment is installed in the outer container, and wherein the plurality of suspension elements includes the pair of folding suspension elements.

2. The packaging system of claim 1, wherein the outer container and the inner compartment are formed from a single panel of the packaging system material.

3. The packaging system of claim 1, wherein the panel forming the inner compartment is an extension of one of the outer container walls, the panel forming the inner compartment extending into the outer container volume to form the inner compartment bottom, and wherein the panel forming the inner compartment bottom is further folded to form the inner compartment back, the inner compartment top, the inner compartment front, and the two opposing inner compartment ends.

4. The packaging system of claim 3, and wherein the panel forming the inner compartment is further configured to form the plurality of suspension elements configured to maintain an air gap between the inner compartment and the outer container.

5. The packaging system of claim 4, wherein the portion of the packaging system material forming the inner compartment bottom extends outwardly beyond the two opposing inner compartment ends forming a pair of folded suspension elements extending from the inner compartment ends to an inner side of the outer container end walls.

6. The packaging system of claim 1, wherein the outer container top includes a top portion, a front flap, and a pair of closure tabs, wherein the outer container end walls include a pair of closure flap retention slots disposed on a front end of each opposing outer container end, wherein the closure flap retention slots retain the closure tabs securing the outer container top when the outer container is in a closed configuration.

7. The packaging system of claim 1, wherein the packaging system material is one of corrugated board, paper board, flexible plastics, foamed plastics, rigid plastics, corrugated plastics.

8. The packaging system of claim 1, wherein the outer container is selectively closeable.

9. The packaging system of claim 8, wherein the inner compartment is selectively closeable while the outer container is in an open configuration.

10. The packaging system of claim 1, wherein each of the folding suspension elements extending from the ends of the inner compartment are wider than a width of the inner compartment such that a width of the folding suspension elements maintains a front air gap between the inner compartment front and the outer container, and a rear air gap between the inner compartment back and the outer container when the inner compartment is installed in the outer container.

11. The packaging system of claim 1, wherein the first direction is an upwards direction and the second direction is a downwards direction.

12. The packaging system of claim 1, wherein the first direction is a downwards direction and the second direction is an upwards direction.

* * * * *